US010789870B2

(12) United States Patent
Kim et al.

(10) Patent No.: US 10,789,870 B2
(45) Date of Patent: Sep. 29, 2020

(54) DISPLAY DEVICE AND METHOD OF DRIVING THE SAME

(71) Applicant: Samsung Display Co., Ltd., Yongin-si, Gyeonggi-do (KR)

(72) Inventors: Heejoon Kim, Yongin-si (KR); Hoi-Sik Moon, Hwaseong-si (KR); Mingyu Kim, Hwaseong-si (KR); Jeongwoon Lee, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 14 days.

(21) Appl. No.: 16/189,665

(22) Filed: Nov. 13, 2018

(65) Prior Publication Data

US 2019/0197935 A1 Jun. 27, 2019

(30) Foreign Application Priority Data

Dec. 27, 2017 (KR) ..... 10-2017-0181461

(51) Int. Cl.
*G09G 3/20* (2006.01)
*G09G 3/00* (2006.01)
(Continued)

(52) U.S. Cl.
CPC ..... *G09G 3/20* (2013.01); *G09G 3/006* (2013.01); *G09G 3/2092* (2013.01);
(Continued)

(58) Field of Classification Search
CPC ..... G09G 3/006; G09G 3/20; G09G 3/2092; G09G 2300/0426; G09G 2310/0221;
(Continued)

(56) References Cited

U.S. PATENT DOCUMENTS 7,791,572 B2 9/2010 Hwang
9,464,962 B2 10/2016 Kim et al.
(Continued)

FOREIGN PATENT DOCUMENTS

CN 106952627 A 7/2017
CN 106991981 A 7/2017
(Continued)

OTHER PUBLICATIONS

Extended European Search Report dated Mar. 8, 2019, for corresponding European Patent Application No. 18213134.2, 18 pages.

*Primary Examiner* — Nelson M Rosario

(74) *Attorney, Agent, or Firm* — Lewis Roca Rothgerber Christie LLP

(57) ABSTRACT

A display device including a display panel includes a plurality of pixels corresponding to a plurality of regions, an image compensator configured to obtain compensation data for the pixels by performing respective sampling compensation operations for the regions, and to generate compensated image data by compensating input image data based on the compensation data, the compensation data being generated by performing at least two of the sampling compensation operations based on respective sampling matrices having different sizes, and a display panel driver configured to drive the display panel to display an image corresponding to the compensated image data on the display panel.

22 Claims, 26 Drawing Sheets

(51) Int. Cl.
*G09G 3/36* (2006.01)
*G09G 3/3208* (2016.01)

(52) U.S. Cl.
CPC ..... *G09G 3/3208* (2013.01); *G09G 3/3611* (2013.01); *G09G 2300/0426* (2013.01); *G09G 2310/0221* (2013.01); *G09G 2310/0278* (2013.01); *G09G 2320/0233* (2013.01); *G09G 2320/0242* (2013.01); *G09G 2320/0285* (2013.01); *G09G 2330/10* (2013.01); *G09G 2360/145* (2013.01); *G09G 2360/16* (2013.01)

(58) Field of Classification Search
CPC ... G09G 2310/0278; G09G 2320/0233; G09G 2320/0242; G09G 2320/0285; G09G 2330/10; G09G 2360/145; G09G 2360/16; G09G 3/3208; G09G 3/3611
See application file for complete search history.

(56) References Cited

U.S. PATENT DOCUMENTS

| | | | | |
|---|---|---|---|---|
| 9,761,184 | B2 | 9/2017 | Kim et al. | |
| 2005/0184952 | A1 | 8/2005 | Konno et al. | |
| 2008/0309602 | A1 | 12/2008 | Hwang | |
| 2017/0332090 | A1* | 11/2017 | Furihata | H04N 19/136 |
| 2018/0330682 | A1 | 11/2018 | Zhang | |
| 2018/0335882 | A1* | 11/2018 | Yoon | G06F 3/0412 |

FOREIGN PATENT DOCUMENTS

| | | |
|---|---|---|
| KR | 10-1286515 | 5/2008 |
| KR | 10-2014-0121667 | 10/2014 |
| KR | 10-2015-0030013 | 3/2015 |
| KR | 10-2017-0078959 | 7/2017 |
| KR | 10-2017-0087558 | 7/2017 |

* cited by examiner

DISPLAY DEVICE AND METHOD OF DRIVING THE SAME

CROSS-REFERENCE TO RELATED APPLICATION

This application claims priority to and the benefit of Korean Patent Application No. 10-2017-0181461, filed on Dec. 27, 2017 in the Korean Intellectual Property Office (KIPO), the content of which is incorporated herein in its entirety by reference.

BACKGROUND

1. Field

Aspects of the present inventive concept relate generally to a display device.

2. Description of the Related Art

Generally, a display device includes a display panel that displays an image and a display panel driver that drives the display panel. The display panel includes a plurality of gate lines extending in a first direction, a plurality of data lines extending in a second direction that is perpendicular to the first direction, and a plurality of pixels that are connected to the gate lines and the data lines. The display panel driver includes a gate driver that outputs gate signals to the gate lines, and a data driver that outputs data signals to the data lines.

Due to variations of the pixels in a manufacturing process, a stain (e.g., a Mura, a smudge, or the like) may be displayed (or generated) on the display panel. However, the display device may remove the stain of the display panel using compensation data of the pixels. Here, a high-resolution display device may include a high-capacity memory device in order to store the compensation data for all pixels according to gray-scale values. However, because there are limits to increasing a capacity of a memory device included in the display device, the compensation data for the pixels may be generated by performing an interpolation on compensation data for sampling pixels. However, a stain having a line (e.g., straight line) shape or a grid shape may not be properly removed.

The above information disclosed in this Background section is for enhancement of understanding of the background of the invention and therefore it may contain information that does not form prior art.

SUMMARY

Aspects of some embodiments of the present inventive concept are directed toward a display device that can remove a stain (e.g., a Mura, a smudge, or the like) of a display panel.

Aspects of some embodiments are directed toward a method of driving the display device.

According to some example embodiments, there is provided a display device including: a display panel including a plurality of pixels corresponding to a plurality of regions; an image compensator configured to obtain compensation data for the pixels by performing respective sampling compensation operations for the regions, and to generate compensated image data by compensating input image data based on the compensation data, the compensation data being generated by performing at least two of the sampling compensation operations based on respective sampling matrices having different sizes; and a display panel driver configured to drive the display panel to display an image corresponding to the compensated image data on the display panel.

In some embodiments, the regions include a first region, a second region, a third region, and a fourth region, wherein the fourth region corresponds to at least a portion of a region at which a first stain corresponding in location to a first line extending in a first direction intersects with a second stain corresponding in location to a second line extending a second direction that is different from the first direction, wherein the third region corresponds to at least a portion of a region corresponding to the second line, wherein the second region corresponds to at least a portion of a region corresponding to the first line, and wherein the first region corresponds to at least a portion of a region other than the second region, the third region, and the fourth region.

In some embodiments, the sampling compensation operations include a first sampling compensation operation, a second sampling compensation operation, a third sampling compensation operation, and a fourth sampling compensation operation, wherein the first sampling compensation operation generates the compensation data for the first region based on a first sampling matrix having a size of R1 pixel-rows and C1 pixel-columns, where R1 and C1 are integers greater than 1, wherein the second sampling compensation operation generates the compensation data for the second region based on a second sampling matrix having a size of R2 pixel-rows and C2 pixel-columns, where R2 is an integer greater than or equal to R1, and C2 is an integer greater than or equal to 1 and smaller than C1, wherein the third sampling compensation operation generates the compensation data for the third region based on a third sampling matrix having a size of R3 pixel-rows and C3 pixel-columns, where R3 is an integer greater than or equal to 1 and smaller than R1, and C3 is an integer greater than or equal to C1, and wherein the fourth sampling compensation operation generates the compensation data for the fourth region based on a fourth sampling matrix having a size of R4 pixel-rows and C4 pixel-columns, where R4 is an integer greater than or equal to 1 and smaller than R1, and C4 is an integer greater than or equal to 1 and smaller than C1.

In some embodiments, the image compensator is configured to perform the first sampling compensation operation, the second sampling compensation operation, the third sampling compensation operation, and the fourth sampling compensation operation sequentially.

In some embodiments, a quantity of the R2 pixel-rows is an integer multiple of a quantity of the R1 pixel-rows, and a quantity of the C3 pixel-columns is an integer multiple of a quantity of the C1 pixel-columns.

In some embodiments, the fourth sampling matrix has a size of one pixel-row and one pixel-column.

In some embodiments, the display panel driver includes: a compensation data storage configured to store different look-up tables for performing the sampling compensation operations; and a data compensator configured to perform the sampling compensation operations based on the look-up tables.

In some embodiments, the data compensator is configured to perform the sampling compensation operations in an order of larger sizes of the sampling matrices.

In some embodiments, the display panel driver further includes: a compensation data generator configured to generate the look-up tables based on a photographed image of the display panel.

In some embodiments, the compensation data generator includes: a luminance profile obtainer configured to obtain a luminance profile of at least a portion of the pixels from the photographed image; a luminance target value obtainer configured to obtain a luminance target value corresponding to a reference gray-scale value; a luminance compensation value generator configured to generate a luminance compensation value based on the luminance profile and the luminance target value; and a compensation data generator configured to generate the compensation data based on the luminance compensation value.

In some embodiments, the display panel includes a first substrate on which a polarizing layer is formed, and the regions are divided based on a boundary of the polarizing layer.

In some embodiments, the boundary of the polarizing layer has a line shape.

In some embodiments, the display panel further includes a second substrate that is opposite to the first substrate, and the polarizing layer is between the first substrate and the second substrate.

In some embodiments, the polarizing layer is a wire grid polarizing layer.

According to some example embodiments, there is provided a method of driving a display device that includes a plurality of pixels corresponding to a plurality of regions, the method including: generating compensated image data by compensating input image data based on compensation data for the pixels; and displaying an image corresponding to the compensated image data, wherein the compensation data is obtained by performing respective sampling compensation operations for the regions, and wherein the compensation data is generated by performing at least two of the sampling compensation operations based on respective sampling matrices having different sizes.

In some embodiments, the regions include a first region, a second region, a third region, and a fourth region, wherein the fourth region corresponds to at least a portion of a region at which a first stain corresponding in location to a first line extending in a first direction intersects with a second stain corresponding in location to a second line extending a second direction that is different from the first direction, wherein the third region corresponds to at least a portion of a region corresponding to the second line, wherein the second region corresponds to at least a portion of a region corresponding to the first line, and wherein the first region corresponds to at least a portion of a region other than the second region, the third region, and the fourth region.

In some embodiments, the sampling compensation operations include a first sampling compensation operation, a second sampling compensation operation, a third sampling compensation operation, and a fourth sampling compensation operation, wherein the first sampling compensation operation generates the compensation data for the first region based on a first sampling matrix having a size of R1 pixel-rows and C1 pixel-columns, where R1 and C1 are integers greater than 1, wherein the second sampling compensation operation generates the compensation data for the second region based on a second sampling matrix having a size of R2 pixel-rows and C2 pixel-columns, where R2 is an integer greater than or equal to R1, and C2 is an integer greater than or equal to 1 and smaller than C1, wherein the third sampling compensation operation generates the compensation data for the third region based on a third sampling matrix having a size of R3 pixel-rows and C3 pixel-columns, where R3 is an integer greater than or equal to 1 and smaller than R1, and C3 is an integer greater than or equal to C1, and wherein the fourth sampling compensation operation generates the compensation data for the fourth region based on a fourth sampling matrix having a size of R4 pixel-rows and C4 pixel-columns, where R4 is an integer greater than or equal to 1 and smaller than R1, and C4 is an integer greater than or equal to 1 and smaller than C1.

In some embodiments, the first sampling compensation operation, the second sampling compensation operation, the third sampling compensation operation, and the fourth sampling compensation operation are sequentially performed.

In some embodiments, the sampling compensation operations are performed based on respective look-up tables.

In some embodiments, the display device includes a substrate on which a polarizing layer is formed, and the regions are divided based on a boundary of the polarizing layer.

According to some example embodiments, there is provided a method of driving a display device that includes a plurality of pixels corresponding to first and second regions, the method including: performing a first sampling compensation operation that generates first compensation data for the first region based on a first sampling matrix; generating first compensated image data by compensating input image data for the first region based on the first compensation data; performing a second sampling compensation operation that generates second compensation data for the second region based on a second sampling matrix; generating second compensated image data by compensating input image data for the second region based on the second compensation data; and displaying an image corresponding to the first and second compensated image data, wherein a first size of the first sampling matrix is larger than a second size of the second sampling matrix.

In some embodiments, the first sampling compensation operation is performed based on a first look-up table, and the second sampling compensation operation is performed based on a second look-up table that is different from the first look-up table.

Therefore, a display device according to example embodiments may effectively remove a stain having a line shape or a grid shape (e.g., a stain located at a boundary between blocks, which is formed by a master mold for forming a polarizing layer) by classifying a plurality of pixels into a plurality of regions based on a location of the stain and by compensating image data for the regions using different sampling compensation operations. Here, the display device may reduce a utilized capacity of a memory device and a system load by variously determining a size of a sampling matrix for removing the stain.

In addition, a method of driving a display device according to example embodiments may enhance display-quality by generating respective compensation data corresponding to respective regions based on respective sampling matrices having different sizes.

BRIEF DESCRIPTION OF THE DRAWINGS

Illustrative, non-limiting, example embodiments will be more clearly understood from the following detailed description taken in conjunction with the accompanying drawings.

DETAILED DESCRIPTION

Hereinafter, embodiments of the present inventive concept will be explained in detail with reference to the accompanying drawings.

Figure 1:
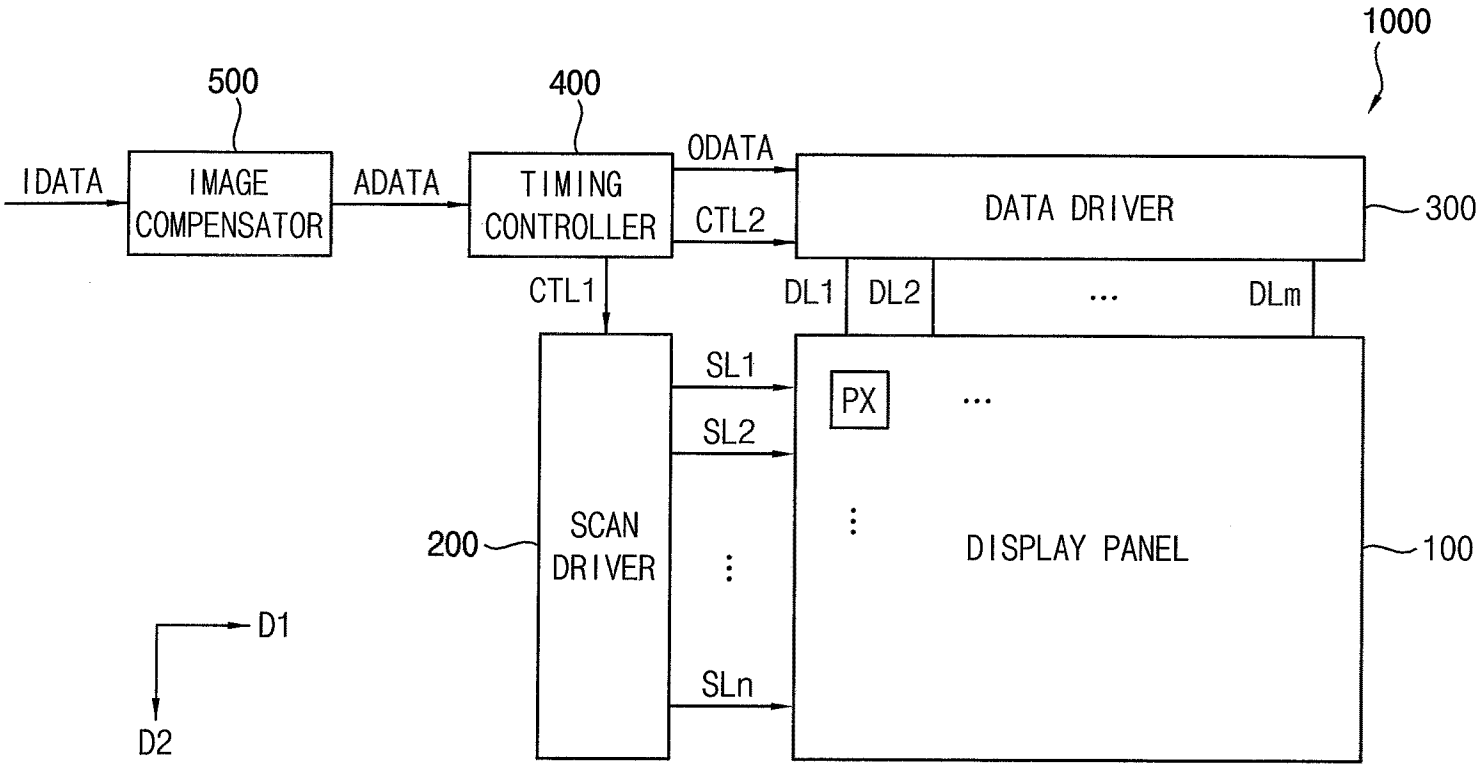
FIG. 1 is a block diagram illustrating a display device according to some example embodiments of the present inventive concept.

FIG. 1 is a block diagram illustrating a display device according to example embodiments of the present inventive concept.

Referring to FIG. 1, the display device 1000 may include a display panel 100, a scan driver 200, a data driver 300, a timing controller 400, and an image compensator 500. In an example embodiment, the display device 1000 may be an organic light emitting display (OLED) device. In this case, the display device 1000 may further include an emission control driver that provides an emission control signal to pixels PX of the display panel 100. In another example embodiment, the display device 1000 may be a liquid crystal display (LCD) device. In this case, the display device 1000 may further include a backlight assembly.

The display panel 100 may include the pixels PX to display an image. For example, the display panel 100 may include n×m pixels PX located at cross-sections of scan lines SL1 through SLn and data lines DL1 through DLm. Each of the pixels PX of the display panel 100 may be included in one of a plurality of regions. In an example embodiment, the regions may be classified based on a location where a stain (e.g., a Mura, a smudge, or the like) is displayed on the display panel 100. For example, the display panel 100 may include a first substrate on which a polarizing layer is formed, and the regions may be divided based on a boundary of the polarizing layer. A method of dividing the regions of the display panel 100 will be described in detail with reference to FIGS. 2 and 3.

The scan driver 200 may provide a scan signal to the pixels PX of the display panel 100 via the scan lines SL1 through SLn based on a first control signal CTL1.

The data driver 300 may generate a data signal based on a second control signal CTL2 and image data ODATA received from the timing controller 400 and may provide the data signal to the pixels PX of the display panel 100 via the data lines DL1 through DLm.

The timing controller 400 may control the scan driver 200 and the data driver 300 to display an image corresponding to compensated image data ADATA on the display panel 100. For example, the timing controller 400 may generate the first control signal CTL1 and the second control signal CTL2 to control the scan driver 200 and the data driver 300, respectively. The first control signal CTL1 for controlling the scan driver 200 may include a scan start signal, a scan clock signal, and/or the like. The second control signal CTL2 for controlling the data driver 300 may include a horizontal start signal, a data clock signal, a load signal, and/or the like. The timing controller 400 may generate digital image data ODATA adapted to an operating condition of the display panel 100 based on the compensated image data ADATA and may provide the digital image data ODATA to the data driver 300.

The image compensator 500 may generate compensation data for the pixels PX by performing respective sampling compensation operations for the regions and may generate the compensated image data ADATA by compensating input image data IDATA based on the compensation data. In some example embodiments, at least two of the sampling compensation operations may be performed in different sizes to generate respective compensation data. In other words, the sampling compensation operations may use sampling matrices having different sizes to generate the compensation data. Here, the sampling compensation operation refers to an operation that divides a target region into blocks each having a sampling matrix size, determines one of the pixels included in each of the blocks (e.g., a pixel located at (1, 1) of each of the blocks) as a sampling pixel, obtains the compensation data for the sampling pixel from a look-up table, and obtains the compensation data for the pixel (hereinafter, referred to as a normal or non-sampling pixel) other than the sampling pixel based on the compensation data for adjacent sampling pixels. Herein, "adjacent" sampling pixels to a normal pixel, or sampling pixels that are "adjacent" to a normal pixel, refer to sampling pixels in blocks that are adjacent to the block of the normal pixel for which compensation data is being determined (also referred to as a target pixel). As described above, a high-resolution display device is required to include a high-capacity memory device in order to store the compensation data for all of the pixels according to gray-scale values. Thus, the display device 1000 may reduce the utilized capacity of a memory device included in the display device 1000 by performing the sampling compensation operation.

The image compensator 500 may generate the compensation data for the pixel located in the region where the stain is observed by using the sampling matrix having a relatively small size. The image compensator 500 may generate the compensation data for the pixel located in the region where the stain is not observed by using the sampling matrix having a relatively large size. A method of generating respective compensation data for the regions will be described in detail with reference to FIGS. 6 to 9 and FIGS. 17 to 21.

Therefore, the display device 1000 may effectively remove the stain having the line shape or the grid shape by classifying the pixels PX into the regions based on the location of the stain and by compensating the image data for the regions using different sampling compensation operations. In addition, the display device may reduce a utilized capacity of a memory device and a system load by variously determining a size of a sampling matrix for removing the stain.

Figure 2:
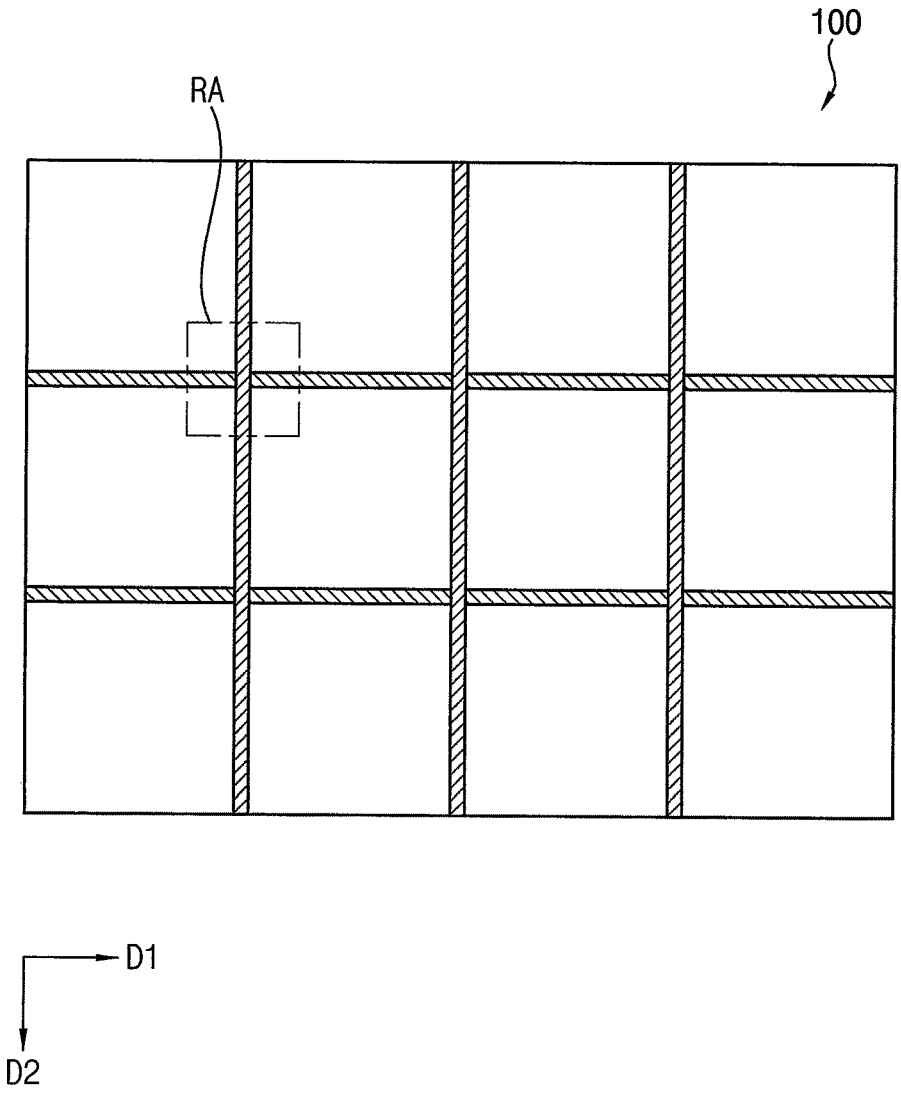
FIG. 2 is a diagram illustrating an example in which a stain having a line shape or a grid shape is displayed on a display panel included in the display device of FIG. 1.
Figure 3:
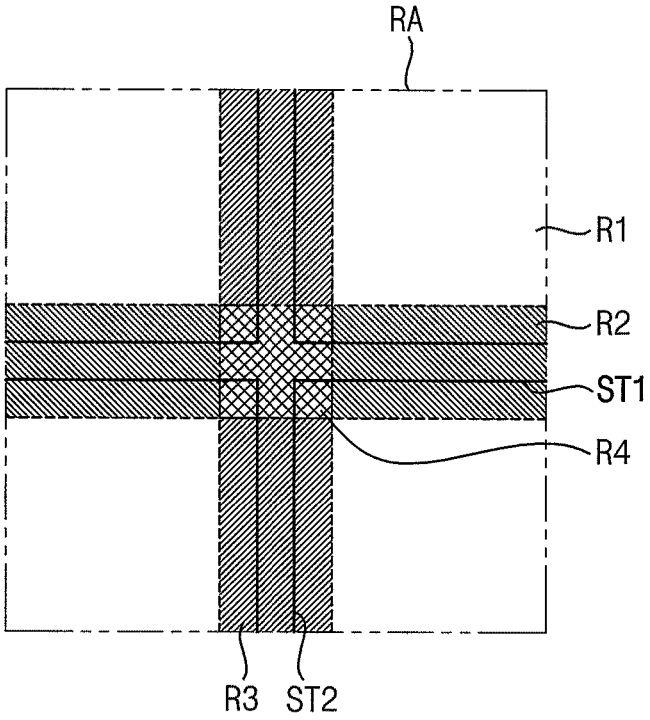
FIG. 3 is a diagram illustrating an example in which pixels included in the display device of FIG. 1 are classified into a plurality of regions, according to some example embodiments of the present inventive concept.

FIG. 2 is a diagram illustrating an example in which a stain having a line shape or a grid shape is displayed on a display panel included in the display device of FIG. 1. FIG. 3 is a diagram illustrating an example in which pixels included in the display device of FIG. 1 are classified into a plurality of regions.

Referring to FIGS. 2 and 3, the pixels may be classified into first through fourth regions R1 through R4 based on a location where a stain is displayed on the display panel 100.

As illustrated in FIG. 2, a stain having a grid shape may be displayed on the display panel 100 due to, for example, deviations of the pixels in a manufacturing process of the display panel 100. For example, the display panel 100 may include a first substrate on which a polarizing layer is formed. Here, a plurality of regions may be distinguished based on a boundary of the polarizing layer. The polarizing layer may be formed using a master mold by an imprinting method. When a size of the master mold is smaller than a size of the display panel 100, the stain having the grid shape may be displayed on the display panel 100. For example, when four blocks are formed in a first direction D1 and when three blocks are formed in a second direction D2, two stains having a line shape (e.g., a straight line shape), which extend in the first direction D1, and three stains having the line shape, which extend in the second direction D2, may be displayed on the display panel 100.

As illustrated in FIG. 3, the pixels may be classified into the first through fourth regions R1 through R4 based on the location where the stain is observed. The first region R1 may be a location where the stain is not observed. The second region R2 may be a location of a first stain ST1 that is formed (or displayed) along a first line extending in the first direction D1 and a peripheral region of the location of the first stain ST1 (i.e., a region surrounding the first stain ST1). The third region R3 may be a location of a second stain ST2 that is formed along a second line extending in the second direction D2 and a peripheral region of the location of the second stain ST2 (i.e., a region surrounding the second stain ST2). The fourth region R4 may be a location corresponding to an intersection of the first stain ST1 extending in the first direction D1 and the second stain ST2 extending in the second direction D2 and a peripheral region of the location corresponding to the intersection (i.e., a region surrounding the intersection of the first stain ST1 and the second stain ST2).

Figure 4:
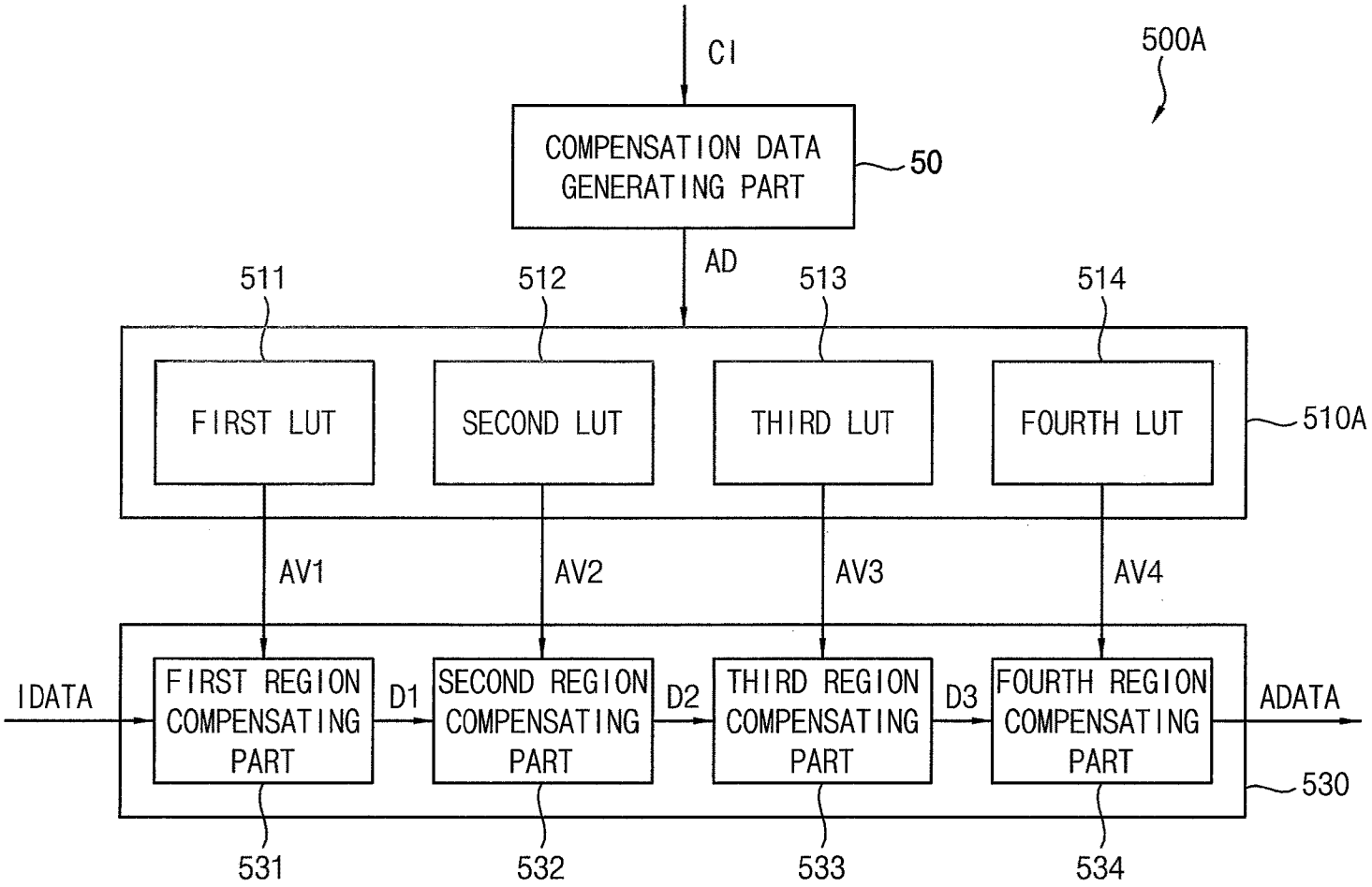
FIG. 4 is a block diagram illustrating an example of an image compensator included in the display device of FIG. 1.
Figure 5:
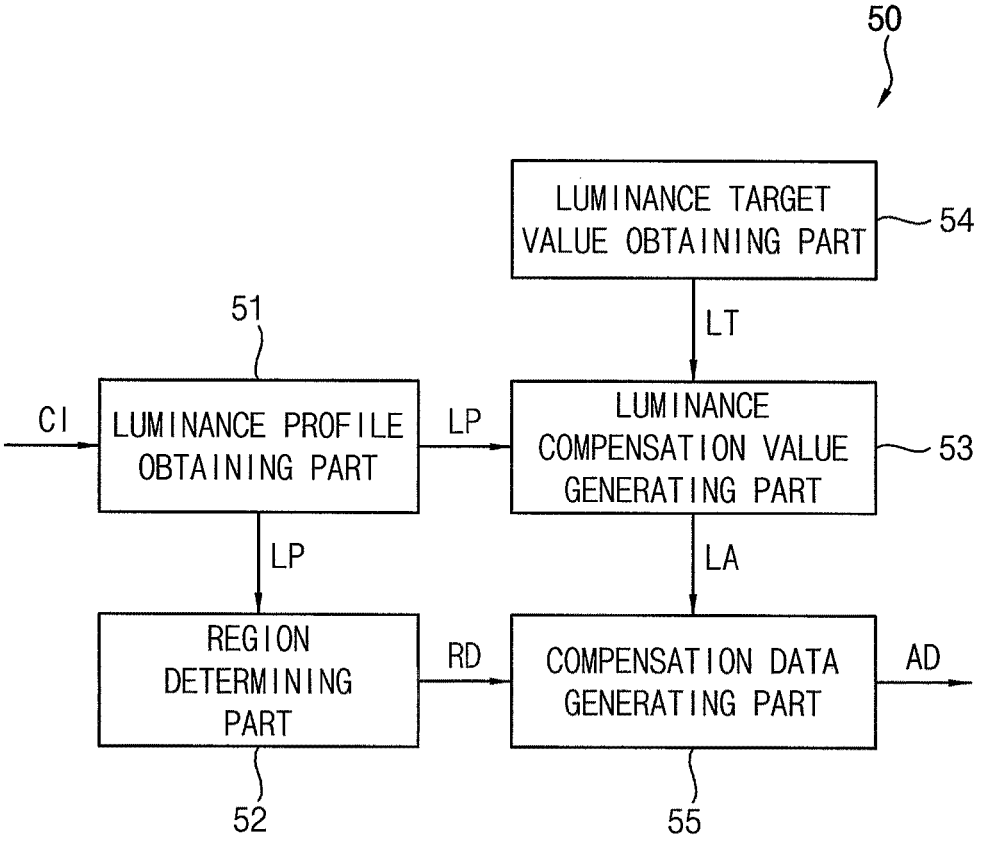
FIG. 5 is a block diagram illustrating an example of a compensation data generator included in the image compensator of FIG. 4.

FIG. 4 is a block diagram illustrating an example of an image compensator included in the display device of FIG. 1. FIG. 5 is a block diagram illustrating an example of a compensation data generator included in the image compensator of FIG. 4.

Referring to FIGS. 4 and 5, the image compensator 500A may compensate (or correct) image data for the first through fourth regions using different sampling compensation operations. In an example embodiment, the image compensator 500A may include a compensation data storing part (e.g., a compensation data storage) 510A and a data compensating part (e.g., a data compensator) 530.

The compensation data storing part 510A may store different look-up tables for respective sampling compensation operations. In an example embodiment, the compensation data storing part 510A may include first through fourth look-up tables 511 through 514 stored in a non-volatile memory device. For example, the first through fourth look-up tables 511 through 514 may be stored in a flash memory device.

The first through fourth look-up tables 511 through 514 may store a compensation value according to a gray-scale value for a sampling pixel. For example, attributes of each of the first through fourth look-up tables 511 through 514 may include a pixel location value, a gray-scale value, a compensation value, and/or the like.

The pixel location value refers to a value indicating a location of the sampling pixel. In an example embodiment, the pixel location value may be data corresponding to (a pixel-row, a pixel-column). In another example embodiment, the pixel location value may be an index value of the pixel.

The gray-scale value refers to a reference grays-scale value. In an example embodiment, each of the first through fourth look-up tables 511 through 514 may include only the compensation data corresponding to preset reference gray-scale values (e.g., 4, 8, 16, 24, 32, 64, 96, 128, 160, 192, 224, and 255). In this case, the compensation value for the gray-scale value other than the preset reference gray-scale value may be obtained by performing a linear interpolation on the compensation value corresponding to the preset reference gray-scale value. In another example embodiment, each of the first through fourth look-up tables 511 through 514 may include data corresponding to all gray-scale values (e.g., 0 through 255).

When the image data of the sampling pixel corresponds to the gray-scale value, the compensation value refers to a value for compensating the image data. In an example embodiment, the compensation value may be an offset for compensating the image data. In another example embodiment, the compensation value may be the gray-scale value after the image data is compensated.

The first look-up table 511 may be for the first sampling compensation operation that generates the compensation data for the first region. The first look-up table 511 may store the compensation values according to the gray-scale values for the first sampling pixels included in the first region to obtain the compensation data for the pixels corresponding to the first region.

The second look-up table 512 may be for the second sampling compensation operation that generates the compensation data for the second region. The second look-up table 512 may store the compensation values according to the gray-scale values for the second sampling pixels included in the second region to obtain the compensation data for the pixels corresponding to the second region.

The third look-up table 513 may be for the third sampling compensation operation that generates the compensation data for the third region. The third look-up table 513 may store the compensation values according to the gray-scale values for the third sampling pixels included in the third region to obtain the compensation data for the pixels corresponding to the third region.

The fourth look-up table 514 may be for the fourth sampling compensation operation that generates the compensation data for the fourth region. The fourth look-up table 514 may store the compensation values according to the gray-scale values for the fourth sampling pixels included in the fourth region to obtain the compensation data for the pixels corresponding to the fourth region.

The data compensating part 530 may perform respective sampling compensation operations based on a plurality of look-up tables. In an example embodiment, the data compensating part 530 may include first through fourth region compensating parts (e.g., first through fourth region compensating circuits) 531 through 534.

The first region compensating part 531 may obtain the first compensation data by performing the first sampling compensation operation based on the first look-up table 511 and may compensate the image data of the pixels corresponding to the first region based on the first compensation data. The first sampling compensation operation may result in the compensation data for the first region based on a sampling matrix having a size of R1 pixel-rows and C1 pixel-columns, where R1 and C1 are integers greater than 1 (hereinafter referred to as an R1×C1 sampling matrix or the first sampling matrix). In an example embodiment, the first region compensating part 531 may generate first data D1 by compensating the input image data IDATA based on the first look-up table 511 for an entire region of the display panel. In another example embodiment, the first region compensating part 531 may generate the first data D1 by compensating the input image data IDATA based on the first look-up table 511 for only the first region of the display panel.

The second region compensating part 532 may obtain the second compensation data by performing the second sampling compensation operation based on the second look-up table 512 and may compensate the image data of the pixels corresponding to the second region based on the second compensation data. The second sampling compensation operation may result in the compensation data for the second region based on a sampling matrix having a size of R2 pixel-rows and C2 pixel-columns, where R2 is an integer greater than or equal to R1, and C2 is an integer greater than or equal to 1 and smaller than C1 (hereinafter referred to as an R2×C2 sampling matrix or the second sampling matrix). In an example embodiment, the second region compensating part 532 may generate second data D2 by compensating the first data D1 based on the second look-up table 512 for the region corresponding to the stain extending in the first direction D1 (e.g., the second region and the fourth region in FIG. 3). The image data of the second and fourth regions of the first data D1 may be overwritten. In another example embodiment, the second region compensating part 532 may generate the second data D2 by compensating the first data D1 based on the second look-up table 512 for only the second region.

The third region compensating part 533 may obtain the third compensation data by performing the third sampling compensation operation based on the third look-up table 513, and may compensate the image data of the pixels corresponding to the third region based on the third compensation data. The third sampling compensation operation may result in the compensation data for the third region based on a sampling matrix having a size of R3 pixel-rows and C3 pixel-columns, where R3 is an integer greater than or equal to 1 and smaller than R1 and C3 is an integer greater than or equal to C1 (hereinafter referred to as an R3×C3 sampling matrix or the third sampling matrix). In an example embodiment, the third region compensating part 533 may generate third data D3 by compensating the second data D2 based on the third look-up table 513 for the region corresponding to the stain extending in the second direction D2 (e.g., the third region and the fourth region in FIG. 3). The image data of the third and fourth regions of the second data D2 may be overwritten. In another example embodiment, the third region compensating part 533 may generate the third data D3 by compensating the second data D2 based on the third look-up table 513 for only the third region.

The fourth region compensating part 534 may obtain the fourth compensation data by performing the fourth sampling compensation operation based on the fourth look-up table 514 and may compensate the image data of the pixels corresponding to the fourth region based on the fourth compensation data. The fourth sampling compensation operation may result in the compensation data for the fourth region based on a sampling matrix having a size of R4 pixel-rows and C4 pixel-columns, where R4 is an integer greater than or equal to 1 and smaller than R1 and C4 is an integer greater than or equal to 1 and smaller than C1 (hereinafter referred to as an R4×C4 sampling matrix or the fourth sampling matrix). In an example embodiment, the fourth region compensating part 534 may generate the compensated image data ADATA by compensating the third data D3 based on the fourth look-up table 514 for the location corresponding to intersections of the stain extending in the first direction D1 and the stain extending in the second direction D2 and the peripheral region of the location (e.g., the fourth region in FIG. 3). The image data of the fourth region of the third data D3 may be overwritten.

In conclusion, the image compensator 500A may be implemented by a relatively simple hardware structure by removing the stain in the manner of performing sampling compensation operations in the order of larger sizes of the sampling matrices and overwriting the image data.

The first through fourth look-up tables 511 through 514 of the image compensator 500A may be generated by the compensation data generating part (e.g., the compensation data generator) 50. In an example embodiment, the compensation data generating part 50 may be located outside the display device 1000 and may set the first through fourth look-up tables 511 through 514 in a manufacturing phase of the display device 1000. In another example embodiment, the compensation data generating part 50 may be located inside the display device 1000 and may set the first through fourth look-up tables 511 through 514 in at least one of a manufacturing phase, an initial setting phase, and a driving phase of the display device 1000. The compensation data generating part 50 may generate data of the first through fourth look-up tables 511 through 514 based on photographed image data CI of the display panel 100. For example, the compensation data generating part 50 may generate the compensation data stored in the first through fourth look-up tables 511 through 514 in the initial setting phase or the manufacturing phase of the display device 1000.

As illustrated in FIG. 5, the compensation data generating part 50 may include a luminance profile obtaining part (e.g., a luminance profile obtainer) 51, a region determining part (e.g., a region determiner) 52, a luminance compensation value generating part (e.g., a luminance compensation value generator) 53, a luminance target value obtaining part (e.g., a luminance target value obtainer) 54, and a compensation data generating part 55.

The luminance profile obtaining part 51 may obtain a luminance profile LP of at least a portion of the pixels from the photographed image data CI of the display panel 100. For example, the photographed image data CI may be generated by photographing the display panel 100 that displays an image in which all pixels have the same gray-scale value (i.e., the reference gray-scale value). The luminance profile obtaining part 51 may generate the luminance profile LP for the reference gray-scale value by obtaining a luminance value for the pixels from the photographed image data CI.

The region determining part 52 may output region data RD for distinguishing the first through fourth regions based on the luminance profile LP.

The luminance target value obtaining part 54 may obtain a luminance target value LT corresponding to the reference gray-scale value. For example, the luminance target value obtaining part 54 may obtain the luminance target value LT corresponding to the reference gray-scale value from a memory device that stores the luminance target value LT according to the reference gray-scale value.

The luminance compensation value generating part 53 may generate a luminance compensating value LA based on the luminance profile LP and the luminance target value LT. For example, the luminance compensation value generating part 53 may calculate the luminance compensation value LA as a difference between the luminance profile LP and the luminance target value LT.

The compensation data generating part 55 may generate compensation data AD based on the luminance compensation value LA. For example, the compensation data generating part 55 may output the compensation data AD corresponding to the first luminance compensation value LA using a gamma curve. In addition, the compensation data generating part 55 may store data in the first through fourth look-up tables 511 through 514 based on the compensation data AD and the region data RD. For example, the compensation data generating part 55 may store the compensation values according to the gray-scale values for the sampling pixels of the entire region of the display panel 100 in the first look-up table 511. The compensation data generating part 55 may determine the second through fourth regions and may store the compensation values according to the gray-scale values for the sampling pixels included in the second through fourth regions in the second through fourth look-up tables 512, 513, and 514, respectively.

Although it is described above that the image compensator 500A sets the data of the compensation data storing part 510A using the compensation data generating part 50, the data of the compensation data storing part 510A may be set in various suitable ways.

Figure 6:
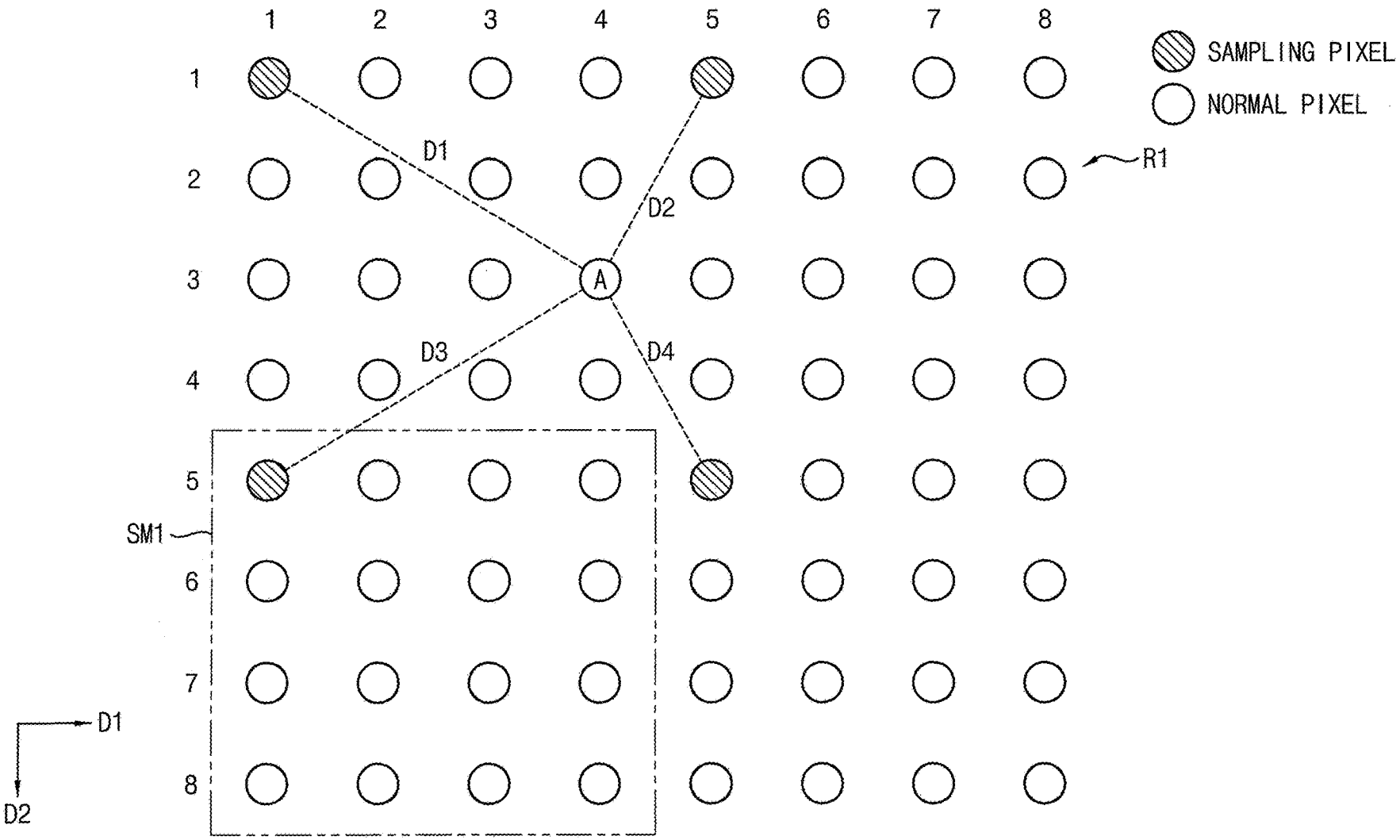
FIG. 6 is a diagram illustrating an example in which a first compensation data for a first region is generated by a first sampling compensation operation, according to some example embodiments of the present inventive concept.

FIG. 6 is a diagram illustrating an example in which a first compensation data for a first region is generated by a first sampling compensation operation, according to some example embodiments of the present inventive concept.

Referring to FIG. 6, the first compensation data for the pixels may be generated by the first sampling compensation operation in the first region R1 corresponding to the location where the stain is not observed.

The first sampling matrix SM1 for the first sampling compensation operation may be a 4×4 sampling matrix, according to some examples. The first sampling compensation operation may divide the first region R1 into blocks each having a size of the 4×4 sampling matrix and may determine one of 16 pixels included in each of the blocks (e.g., the pixel of (first pixel-row, first pixel-column) in each of the blocks) as the sampling pixel. For example, the pixel of (first pixel-row, first pixel-column) in each sampling matrix, for example, the (1, 1) pixel, the (1, 5) pixel, the (5, 1) pixel, the (5, 5) pixel, etc., may be selected as the sampling pixel. The compensation values for the sampling pixels may be obtained from the first look-up table. The compensation value for the normal (i.e., non-sampling) pixel (e.g., the (3, 4) pixel) other than the sampling pixel may be obtained based on the compensation values for the sampling pixels (e.g., the (1, 1) pixel, the (5, 1) pixel, the (1, 5) pixel, and the (5, 5) pixel) that are adjacent to the normal pixel. For example, the compensation value for the normal pixel may be obtained by performing a bilinear interpolation on the compensation values for the sampling pixels that are adjacent to the normal pixel.

In an example embodiment, the compensation value for a target pixel (e.g., the (3, 4) pixel) may be generated by calculating a weighted average using the compensation values for the sampling pixels that are adjacent to the target pixel and weights of the sampling pixels. For example, the weight W'1 of the (1, 1) pixel (i.e., the first sampling pixel) may be inversely proportional to a first distance D1 between the (1, 1) pixel and the (3, 4) pixel. The weight W'2 of the (1, 5) pixel (i.e., the second sampling pixel) may be inversely proportional to a second distance D2 between the (1, 5) pixel and the (3, 4) pixel. The weight W'3 of the (5, 1) pixel (i.e., the third sampling pixel) may be inversely proportional to a third distance D3 between the (5, 1) pixel and the (3, 4) pixel. The weight W'4 of the (5, 5) pixel (i.e., the fourth sampling pixel) may be inversely proportional to a fourth distance D4 between the (5, 5) pixel and the (3, 4) pixel. For example, the weight of the sampling pixel may be calculated using [Equation 1] below:

$$W'k = \frac{1}{Dk} \qquad \text{Equation 1}$$

where W'k denotes the weight of the (k)th sampling pixel, and Dk denotes the distance between the (k)th sampling pixel and the target pixel.

In addition, a sum of the weights may be set as 1 to set the compensation value for the target pixel as a weighted average value of the compensation values for the sampling pixels. Thus, the weights of the sampling pixels may be recalculated using [Equation 2] below:

$$Wk = \frac{W'k}{\sum W'i} \quad \text{Equation 2}$$

where Wk denotes the recalculated weight of the (k)th sampling pixel, and W'k denotes the weight of the (k)th sampling pixel.

Thus, the compensation value for the normal pixel may be calculated using [Equation 3] below:

$$AV = \sum_{i}^{sampling\ pixel} AViWi \quad \text{Equation 3}$$

where AV denotes the compensation value for the normal pixel, AVi denotes the compensation value for the sampling pixel, and Wi denotes the weight of the sampling pixel.

Although it is illustrated in FIG. 6 that the first sampling matrix SM1 is the 4×4 sampling matrix, the first sampling matrix SM1 is not limited thereto. In other words, the first sampling matrix SM1 may be set to have various suitable sizes.

Figure 7A:
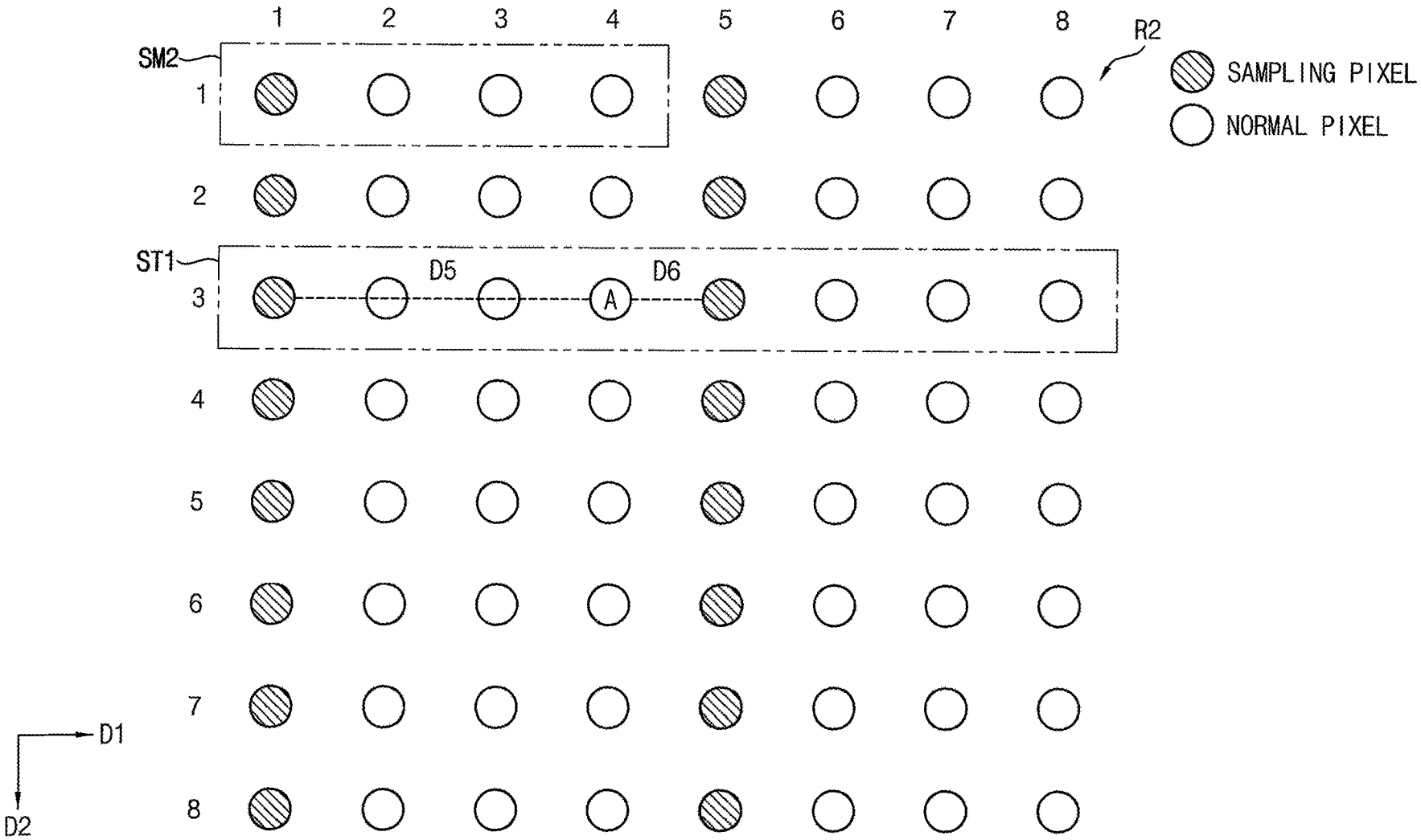
FIGS. 7A-7B are diagrams illustrating an example in which a second compensation data for a second region is generated by a second sampling compensation operation, according to some example embodiments of the present inventive concept.
Figure 7B:
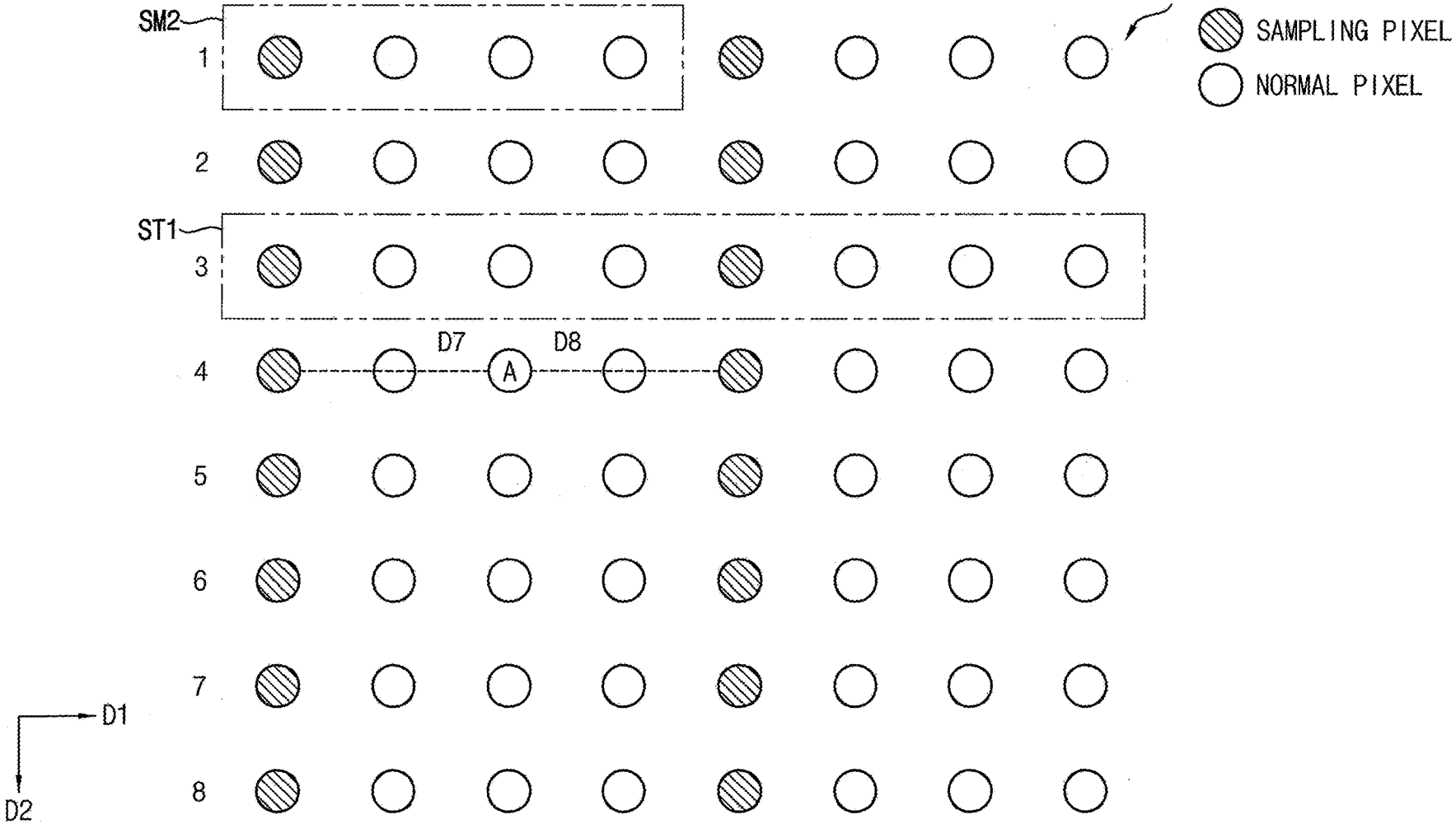

FIGS. 7A and 7B are diagrams illustrating an example in which a second compensation data for a second region is generated by a second sampling compensation operation, according to some example embodiments of the present inventive concept.

Referring to FIGS. 7A and 7B, the second compensation data for the pixels may be generated by the second sampling compensation operation in the second region R2 including the first stain ST1 that is displayed along the first line extending in the first direction D1.

The second sampling matrix SM2 for the second sampling compensation operation may be a 1×4 sampling matrix, according to some examples. Thus, in the second sampling compensation operation, one sampling pixel may be selected among four pixels. For example, the pixels located in the first pixel-column, the fifth pixel-column, etc., which are included in the second region R2, may be selected as the sampling pixels. The compensation values for the sampling pixels may be obtained from the second look-up table. The compensation value for the normal (non-sampling) pixel (e.g., the (3, 4) pixel) other than the sampling pixel may be obtained based on the compensation values for the sampling pixels (e.g., the (3, 1) pixel and the (3, 5) pixel) that are adjacent to the normal pixel. For example, the compensation value for the normal pixel may be obtained by performing a linear interpolation on the compensation values for the sampling pixels that are adjacent to the normal pixel.

As illustrated in FIG. 7A, in the second region R2, the compensation value for the (3, 4) pixel may be generated by calculating a weighted average using the compensation values for the sampling pixels (e.g., the (3, 1) pixel and the (3, 5) pixel) that are adjacent to the (3, 4) pixel and weights of the sampling pixels. The weight of the (3, 1) pixel may be inversely proportional to a fifth distance D5 between the (3, 1) pixel and the (3, 4) pixel. Here, the weight of the (3, 5) pixel may be inversely proportional to a sixth distance D6 between the (3, 5) pixel and the (3, 4) pixel. Because a method of generating the compensation value for the normal pixel is described above, repeat descriptions will not be provided.

As illustrated in FIG. 7B, in the second region R2, the compensation value for the (4, 3) pixel may be generated by calculating a weighted average using the compensation values for the sampling pixels (e.g., the (4, 1) pixel and the (4, 5) pixel) that are adjacent to the (4, 3) pixel and weights of the sampling pixels. Here, the weight of the (4, 1) pixel may be inversely proportional to a seventh distance D7 between the (4, 1) pixel and the (4, 3) pixel. The weight of the (4, 5) pixel may be inversely proportional to an eighth distance D8 between the (4, 5) pixel and the (4, 3) pixel.

In FIG. 7A, because the compensation value for the (3, 4) pixel located on the first stain ST1 is generated based on the compensation value for the (3, 1) pixel and the (3, 5) pixel that are the sampling pixels located on the first stain ST1, an error of the generated compensation value may be relatively small. In FIG. 7B, because the compensation value for the (4, 3) pixel located outside the first stain ST1 is generated based on the compensation value for the (4, 1) pixel and the (4, 5) pixel that are the sampling pixels located outside the first stain ST1, an error of the generated compensation value may be relatively small.

Although it is illustrated in FIGS. 7A and 7B that the second sampling matrix SM2 is the 1×4 sampling matrix, the second sampling matrix SM2 is not limited thereto. In other words, the second sampling matrix SM2 may be set to have various suitable sizes.

Figure 8A:
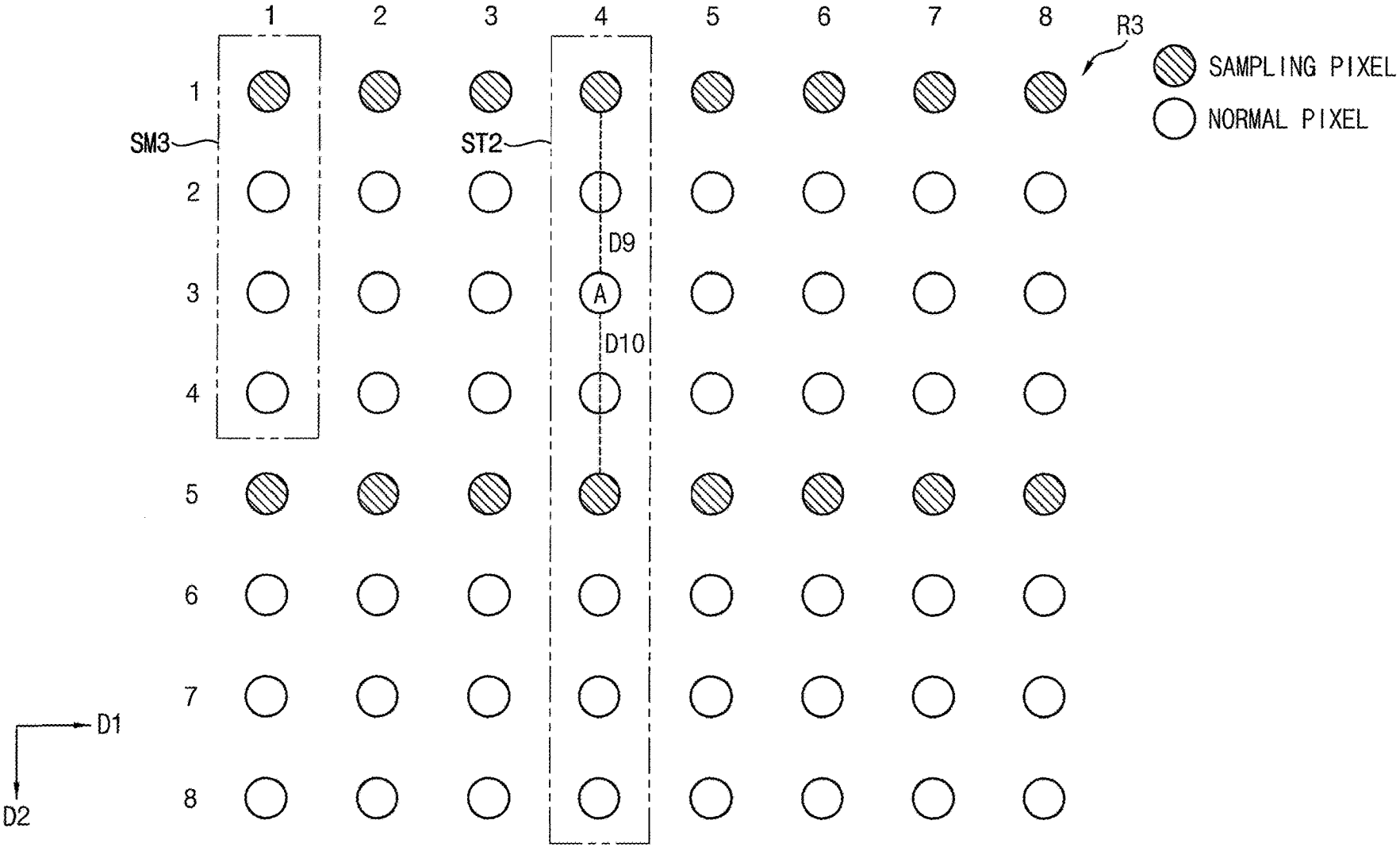
FIGS. 8A-8B are diagrams illustrating an example in which a third compensation data for a third region is generated by a third sampling compensation operation, according to some example embodiments of the present inventive concept.
Figure 8B:
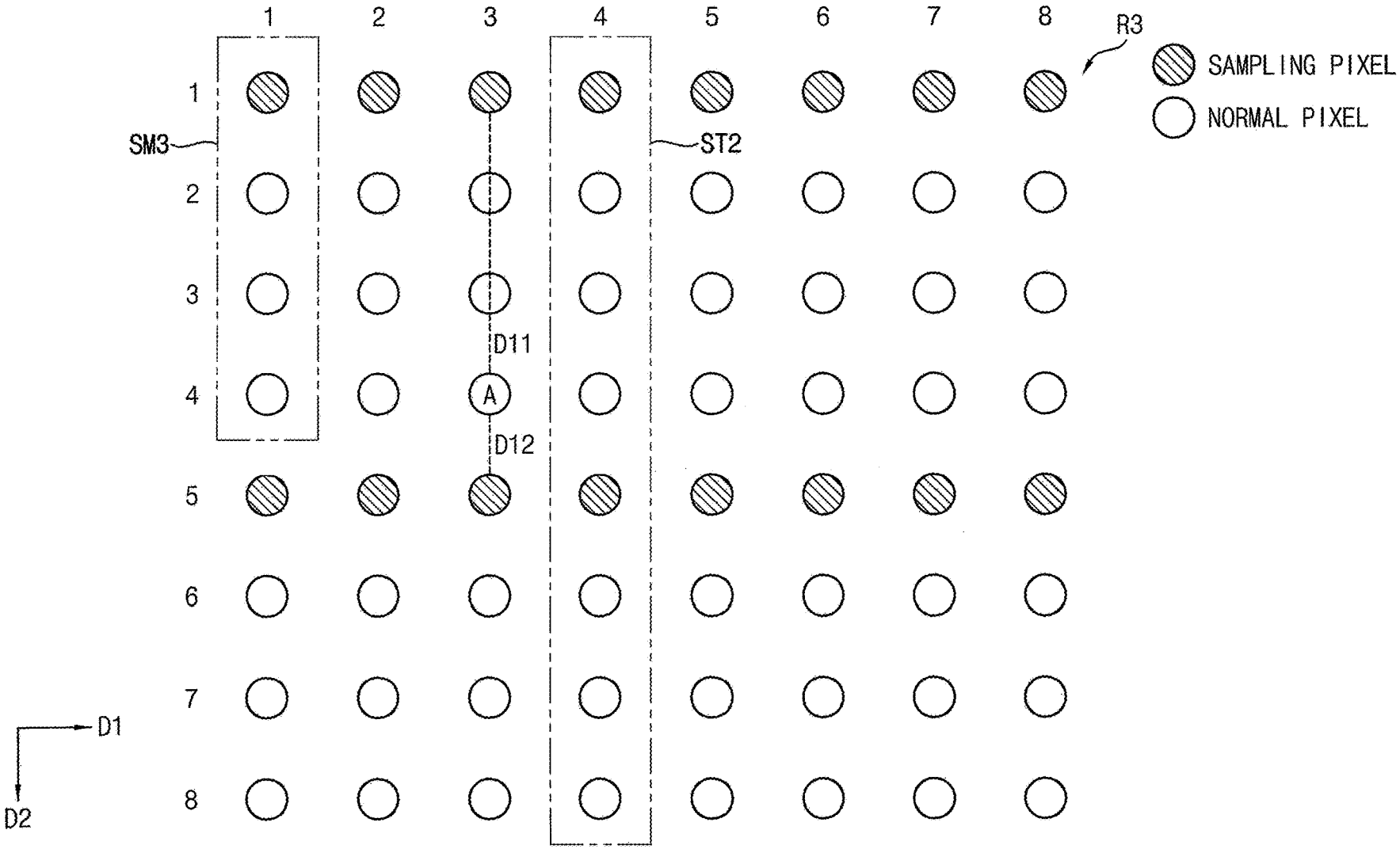

FIGS. 8A and 8B are diagrams illustrating an example in which a third compensation data for a third region is generated by a third sampling compensation operation, according to some example embodiments of the present inventive concept.

Referring to FIGS. 8A and 8B, the third compensation data for the pixels may be generated by the third sampling compensation operation in the third region R3 including the second stain ST2 that is displayed along the second line extending in the second direction D2.

The third sampling matrix SM3 for the third sampling compensation operation may be a 4×1 sampling matrix, according to some examples. Thus, in the third sampling compensation operation, one sampling pixel may be selected among four pixels. For example, the pixels located in the first pixel-row, the fifth pixel-row, etc., which are included in the third region R3, may be selected as the sampling pixel. The compensation values for the sampling pixels may be obtained from the third look-up table. The compensation value for the normal pixel (e.g., the (3, 4) pixel) other than the sampling pixel may be obtained based on the compensation values for the sampling pixels (e.g., the (1, 4) pixel and the (5, 4) pixel) that are adjacent to the normal pixel. For example, the compensation value for the normal pixel may be obtained by performing a linear interpolation on the compensation values for the sampling pixels that are adjacent to the normal pixel.

As illustrated in FIG. 8A, in the third region R3, the compensation value for the (3, 4) pixel may be generated by calculating a weighted average using the compensation values for the sampling pixels (e.g., the (1, 4) pixel and the (5, 4) pixel) that are adjacent to the (3, 4) pixel and weights of the sampling pixels. The weight of the (1, 4) pixel may be inversely proportional to a ninth distance D9 between the (1, 4) pixel and the (3, 4) pixel. The weight of the (5, 4) pixel may be inversely proportional to a tenth distance D10 between the (5, 4) pixel and the (3, 4) pixel.

As illustrated in FIG. 8B, in the second region R3, the compensation value for the (4, 3) pixel may be generated by calculating a weighted average using the compensation values for the sampling pixels (e.g., the (1, 3) pixel and the (5, 3) pixel) that are adjacent to the (4, 3) pixel and weights of the sampling pixels. Here, the weight of the (1, 3) pixel may be inversely proportional to an eleventh distance D11 between the (1, 3) pixel and the (4, 3) pixel. The weight of the (5, 3) pixel may be inversely proportional to a twelfth distance D12 between the (5, 3) pixel and the (4, 3) pixel.

In FIG. 8A, because the compensation value for the (3, 4) pixel located on the second stain ST2 is generated based on the compensation value for the (1, 4) pixel and the (5, 4) pixel that are the sampling pixels located on the second stain ST2, an error of the generated compensation value may be relatively small. In FIG. 8B, because the compensation value for the (4, 3) pixel located outside the second stain ST2 is generated based on the compensation value for the (1, 3) pixel and the (5, 3) pixel that are the sampling pixels located outside the second stain ST2, an error of the generated compensation value may be relatively small.

Although it is illustrated in FIGS. 8A and 8B that the third sampling matrix SM3 is the 4×1 sampling matrix, the third sampling matrix SM3 is not limited thereto. In other words, the third sampling matrix SM3 may be set to have various suitable sizes.

Figure 9:
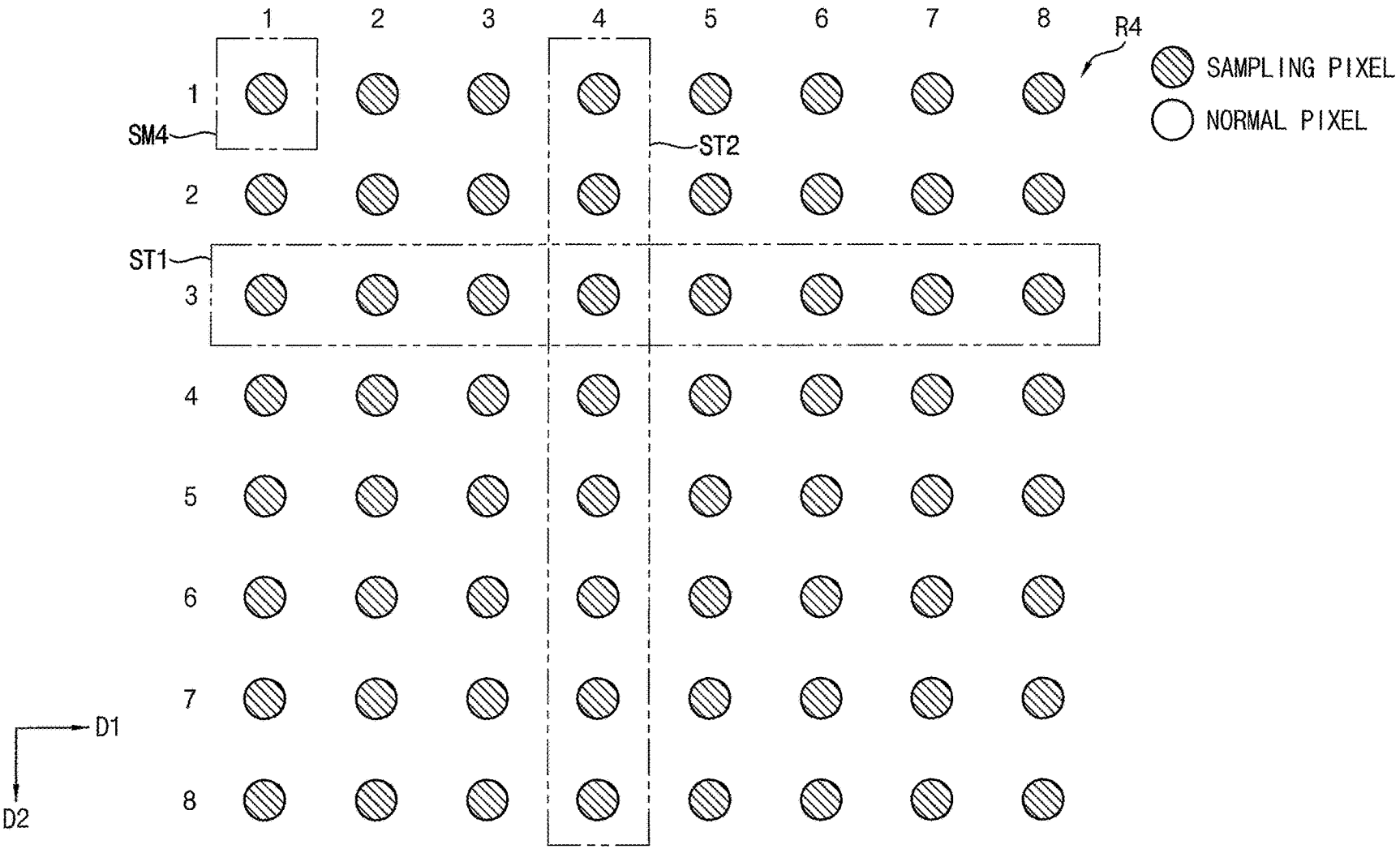
FIG. 9 is a diagram illustrating an example in which a fourth compensation data for a fourth region is generated by a fourth sampling compensation operation, according to some example embodiments of the present inventive concept.

FIG. 9 is a diagram illustrating an example in which a fourth compensation data for a fourth region is generated by a fourth sampling compensation operation, according to some example embodiments of the present inventive concept.

Referring to FIG. 9, the fourth compensation data for the pixels may be generated by the fourth sampling compensation operation in the fourth region R4 including a region at which the first stain ST1 intersects (or overlaps) with the second stain ST2.

The fourth sampling matrix SM4 for the fourth sampling compensation operation may be a 1×1 sampling matrix, according to some examples. Because the compensation value for all pixels included in the fourth region R4 can be obtained from the fourth look-up table, the compensation for the fourth region R4 may be performed without any error.

Although it is illustrated in FIG. 9 that the compensation value for all pixels included in the fourth region R4 is obtained from the fourth look-up table in the fourth sampling compensation operation, the fourth sampling compensation operation is not limited thereto. For example, to reduce capacity of the memory device and the load of the display device, the fourth sampling compensation operation may obtain the compensation value for the pixels included in the fourth region R4 using the 2×2 sampling matrix.

Figure 10A:
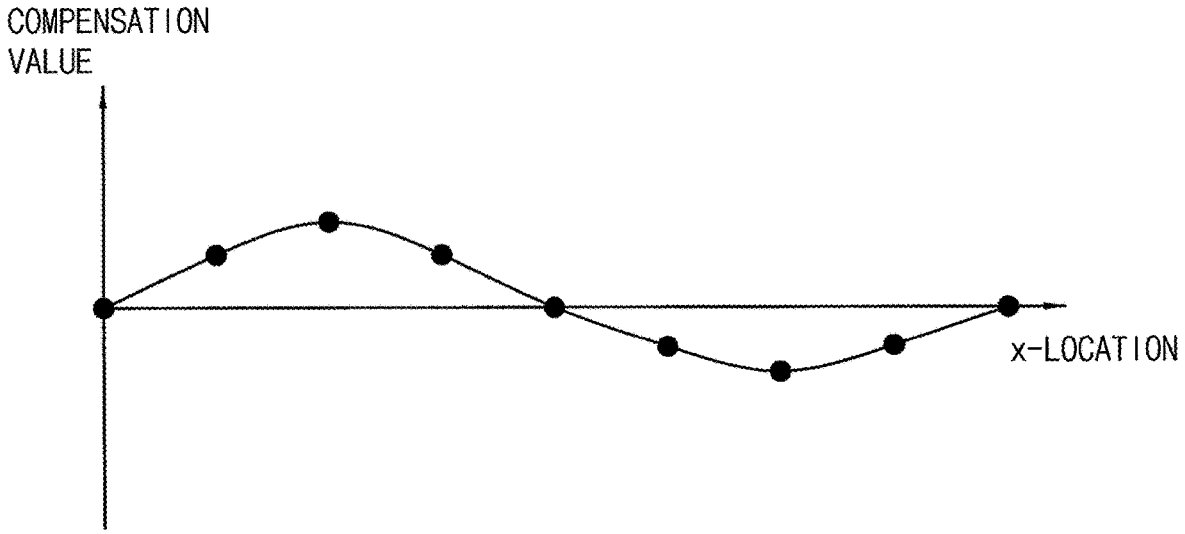
FIGS. 10A-10B are diagrams for illustrating an effect of a second sampling compensation operation, according to some example embodiments of the present inventive concept.
Figure 10B:
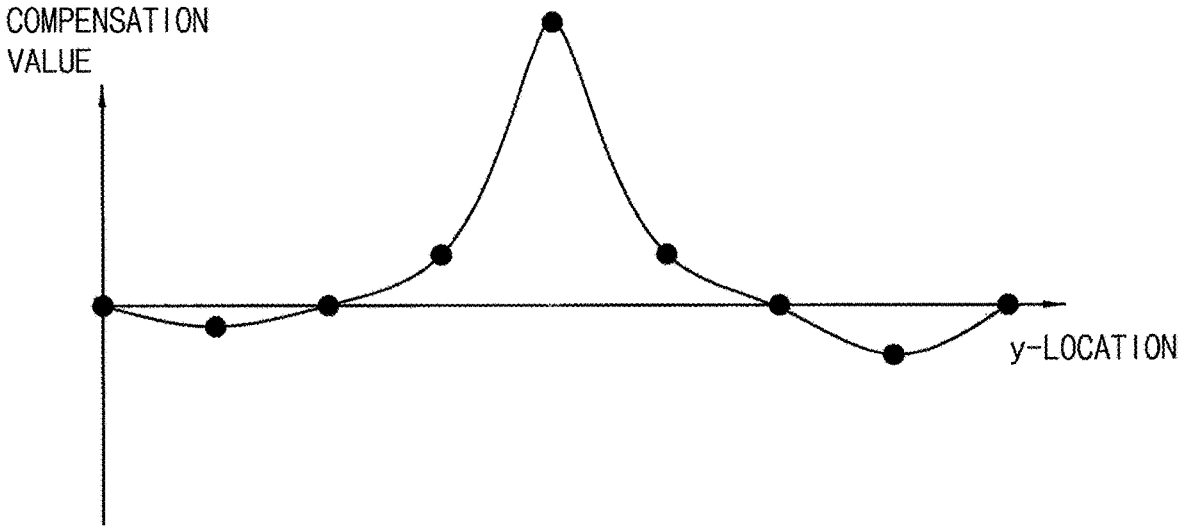

FIGS. 10A and 10B are diagrams for describing an effect of a second sampling compensation operation, according to some example embodiments of the present inventive concept.

Referring to FIGS. 10A and 10B, the second sampling compensation operation may use a sampling matrix having a relatively low height (such as a 1×4 sampling matrix). Thus, the second sampling compensation operation may be applied (or performed) to efficiently reduce an error of the compensation value when a change of the compensation value is relatively large when moving in the second direction D2.

As illustrated in FIG. 10A, because the stain extends in the first direction D1 in the second region, the change of the compensation value may be relatively small when moving in the first direction D1.

As illustrated in FIG. 10B, because the stain extends in the first direction D1 in the second region, the change of the compensation value may be relatively large when moving in the second direction D2 (here, moving in the second direction D2 means crossing the stain that extends in the first direction D1).

Thus, in the second region, the compensation value having a relatively small error may be generated by applying the second sampling compensation operation. As a result, the capacity of the memory device that compensates for the stain may be reduced and efficiency of the display device may be improved because storing the compensation value for all pixels included in the second region in the memory device (i.e., the look-up table) is not required.

Figure 11A:
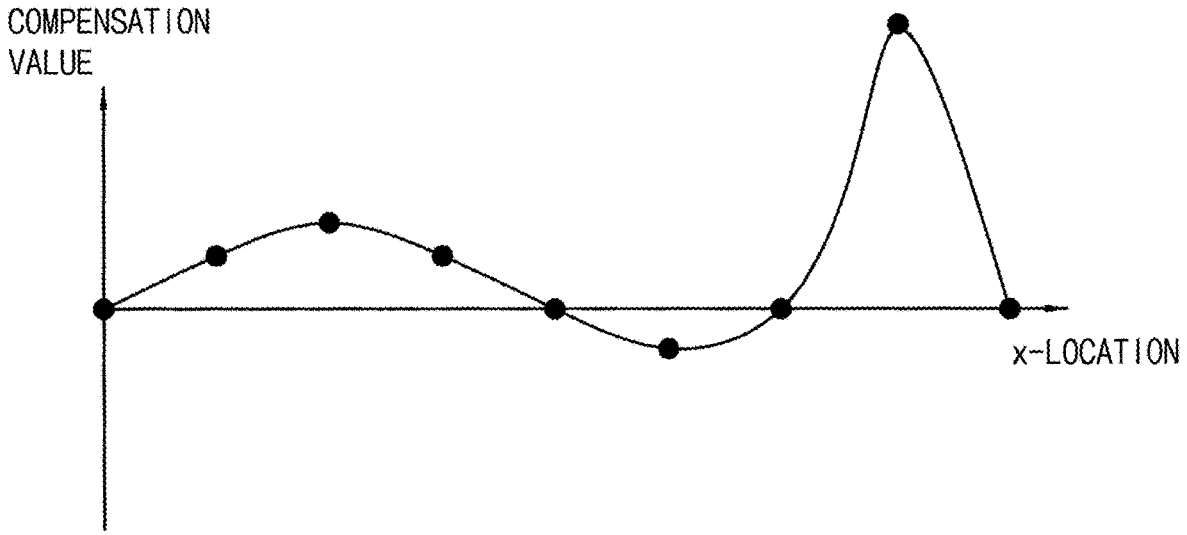
FIGS. 11A-11B are diagrams for illustrating an effect of a third sampling compensation operation, according to some example embodiments of the present inventive concept.
Figure 11B:
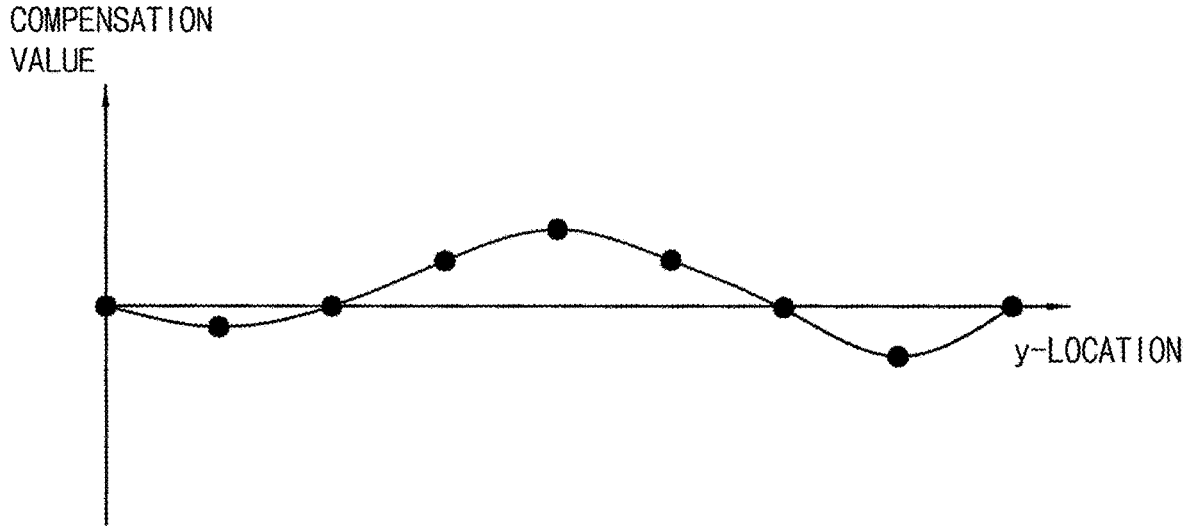

FIGS. 11A and 11B are diagrams for describing an effect of a third sampling compensation operation, according to some example embodiments of the present inventive concept.

Referring to FIGS. 11A and 11B, the third sampling compensation operation may use a sampling matrix having a relatively narrow width (such as a 4×1 sampling matrix). Thus, the third sampling compensation operation may be applied (or performed) to efficiently reduce an error of the compensation value when a change of the compensation value is relatively large when moving in the first direction D1.

As illustrated in FIG. 11A, because the stain extends in the second direction D2 in the third region, the change of the compensation value may be relatively large when moving in the first direction D1 (here, moving in the first direction D1 means crossing the stain that extends in the second direction D2).

As illustrated in FIG. 10B, because the stain extends in the second direction D2 in the third region, the change of the compensation value may be relatively small when moving in the second direction D2.

Thus, in the third region, the compensation value having a relatively small error may be generated by applying the third sampling compensation operation. As a result, the capacity of the memory device that compensates for the stain may be reduced and efficiency of the display device may be improved because storing the compensation value for all pixels included in the third region in the memory device (i.e., the look-up table) is not required.

Figure 12A:
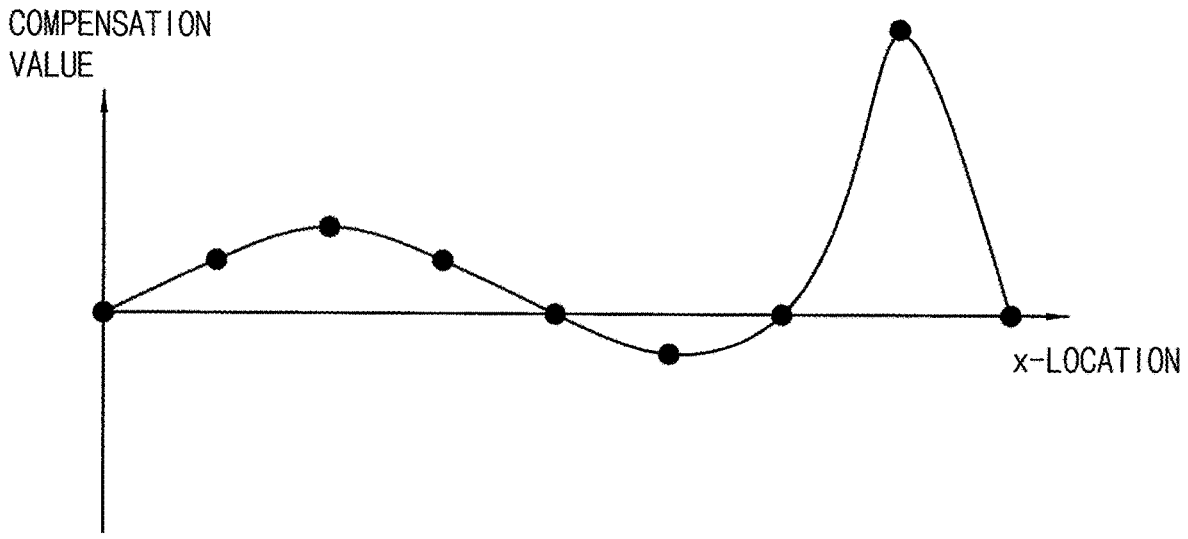
FIGS. 12A-12B are diagrams for illustrating an effect of a fourth sampling compensation operation, according to some example embodiments of the present inventive concept.
Figure 12B:
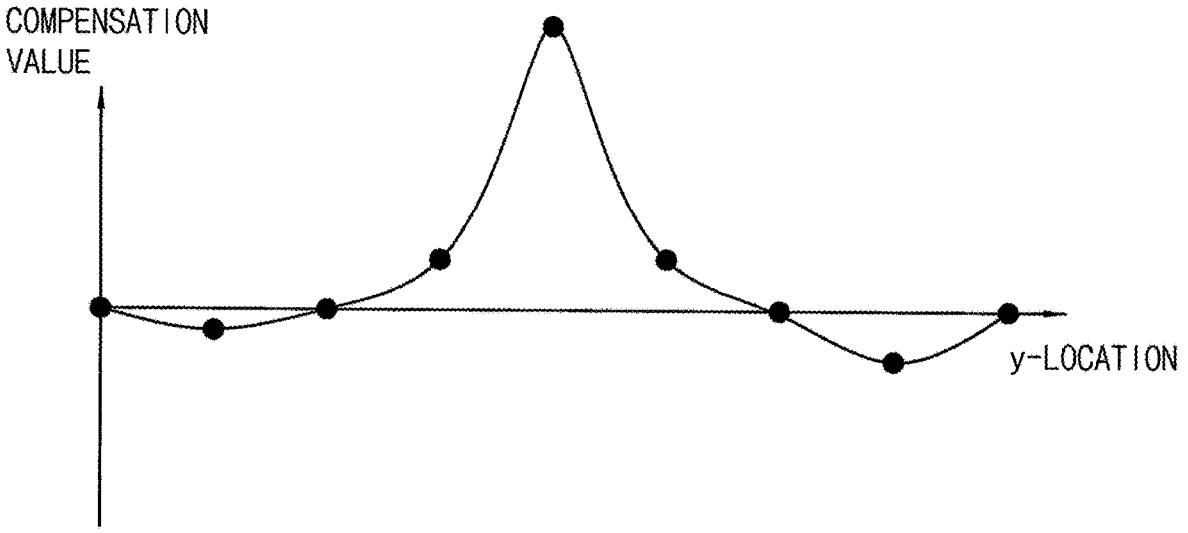

FIGS. 12A and 12B are diagrams for describing an effect of a fourth sampling compensation operation, according to some example embodiments of the present inventive concept.

Referring to FIGS. 12A and 12B, the fourth sampling compensation operation may use a sampling matrix having a relatively low height and a relatively narrow width (such as a 1×1 sampling matrix). Thus, in the fourth region where a change of the compensation value between adjacent pixels is relatively large, the fourth sampling compensation operation may be applied (or performed) to reduce an error of the compensation value.

The fourth region includes the location (or region) at which the first stain extending in the first direction intersects (or overlaps) with the second stain extending in the second direction and the peripheral region of the location. Because the change of the compensation value is relatively large, a large compensation error may occur when the first through third sampling compensation operations are performed. Thus, the fourth sampling compensation operation may be applied in only the fourth region at which the first stain intersects (or overlaps) with the second stain to the extent that the load of the display device is not greatly increased.

Figure 13:
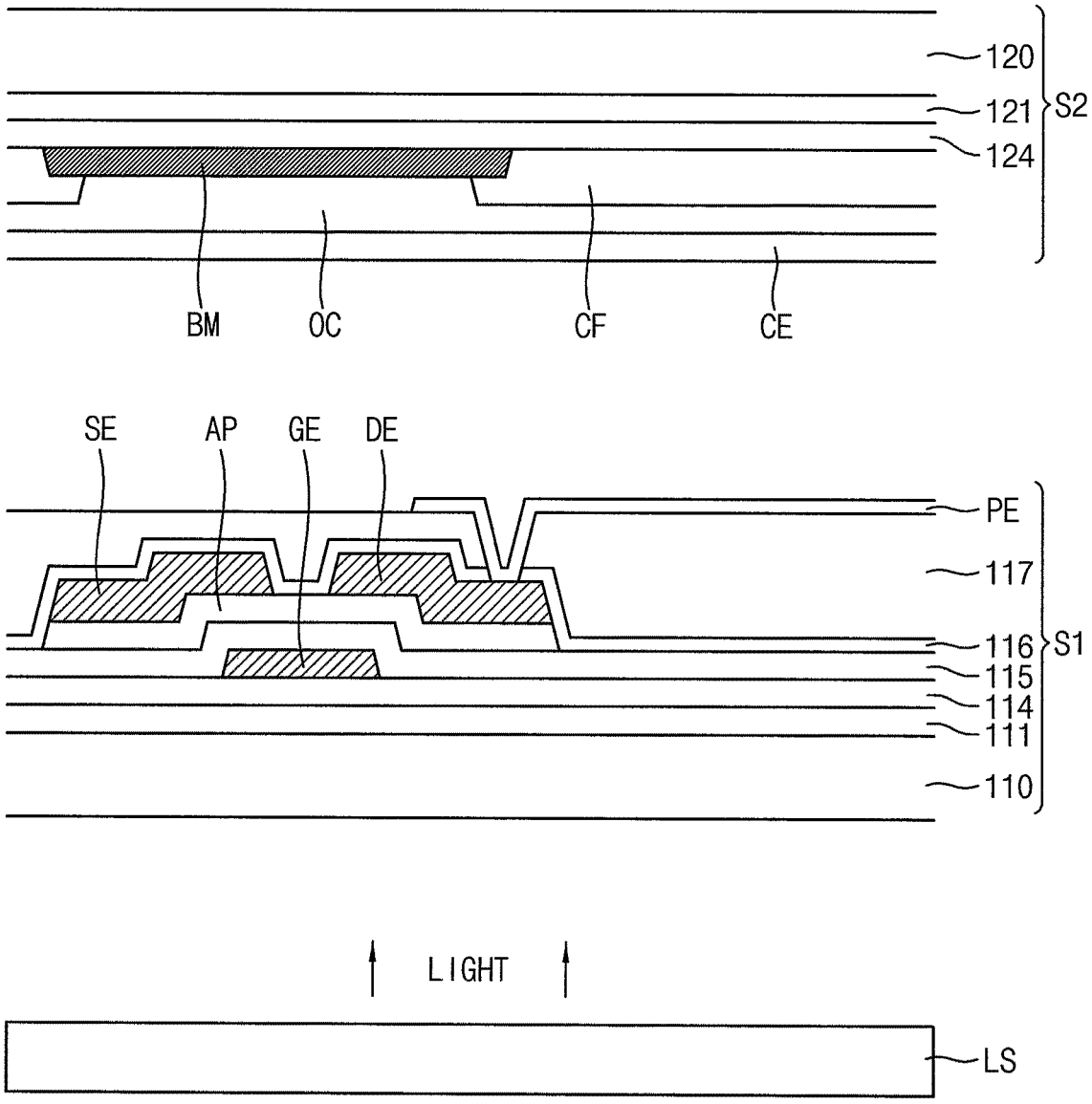
FIG. 13 is a cross-sectional diagram illustrating an example of a structure of a display panel included in the display device of FIG. 1.

FIG. 13 is a cross-sectional diagram illustrating an example of a structure of a display panel included in the display device of FIG. 1.

Referring to FIG. 13, the display panel may include a wire grid polarizing layer to form an in-cell structure.

The display panel may include a first substrate S1, a second substrate S2 that is opposite to the first substrate S1, and a liquid crystal layer disposed between the first substrate S1 and the second substrate S2. The display panel may display an image by receiving light (indicated by LIGHT in FIG. 13) from a light source module LS disposed under the display panel.

The first substrate S1 may include a first base substrate 110, a first buffer member 111, a first polarizing layer 114, a gate electrode GE, a gate insulating layer 115, an active pattern AP, a source electrode SE, a drain electrode DE, a passivation layer 116, an organic insulating layer 117, and a pixel electrode PE.

The first buffer member 111 may be disposed between the first base substrate 110 and the first polarizing layer 114.

The first polarizing layer 114 may include a wire grid array that performs a polarizing function. The wire grid array may extend in a first direction. The wire grid array may include a plurality of linear metal patterns that are arranged in parallel to each other in a second direction, where the first direction intersects with the second direction.

The gate electrode GE, the active pattern AP, the source electrode SE, and the drain electrode DE may compose a thin film transistor. The thin film transistor may be electrically connected to the pixel electrode PE. A thin film transistor array may be formed on the first polarizing layer 114 after the first polarizing layer 114 is formed on the first base substrate 110.

The gate electrode GE may be disposed on the first polarizing layer 114. The gate electrode GE may be electrically connected to a gate line extending in one direction on the base substrate 110.

The gate insulating layer 115 may cover the gate electrode GE.

The active pattern AP may be disposed on the gate insulating layer 115. The active pattern AP may overlap the gate electrode GE. The active pattern AP may form a channel between the source electrode SE and the drain electrode DE.

The source electrode SE may be electrically connected to a data line. The data line, the source electrode SE, and the drain electrode DE may be formed from the same metal layer.

The passivation layer 116 may cover the source electrode SE, the drain electrode DE, and the gate insulating layer 115.

The organic insulating layer 117 may be disposed on the passivation layer 116. The organic insulating layer 117 may planarize the substrate.

The pixel electrode PE may be disposed on the organic insulating layer 117. The pixel electrode PE may be electrically connected to the drain electrode DE. The pixel electrode PE may contact the drain electrode DE via the passivation layer 116 and the organic insulating layer 117. A pixel voltage may be applied to the pixel electrode PE via the thin film transistor. An electric field may be formed by a voltage difference between the pixel voltage applied to the pixel electrode PE and a common voltage applied to the common electrode CE.

The second substrate S2 may include a second base substrate 120, a second buffer member 121, a second polarizing layer 124, a shading member BM, a color filter CF, an over-coating layer OC, and the common electrode CE.

The second buffer member 121 may be disposed between the second base substrate 120 and the second polarizing layer 124.

The second polarizing layer 124 may include a wire grid array that performs a polarizing function. In an example embodiment, the second polarizing layer 124 may include a metal pattern that is perpendicular to the metal pattern of the first polarizing layer 114.

The shading member BM may be disposed on the second polarizing layer 124. The shading member BM may have a matrix shape. The shading member BM may overlap the thin film transistor.

The color filter CF may be disposed on the second polarizing layer 124. The color filter CF may be opposite to the pixel electrode PE.

The over-coating layer OC may cover the shading member BM and the color filter CF.

The common electrode CE may be formed on the over-coating layer OC. The common electrode CE may overlap the pixel electrode PE.

The first polarizing layer 114 and/or the second polarizing layer 124 may be formed using a master mold by an imprinting method. When a size of the master mold is smaller than a size of the display panel, the first polarizing layer 114 and/or the second polarizing layer 124 may not be formed in a single imprinting process. Thus, deviations may occur along a boundary of the master mold. As a result, when the display device displays an image, a stain having a grid shape may be observed (or visually recognized) along the boundary of the polarizing layer.

Figure 14:
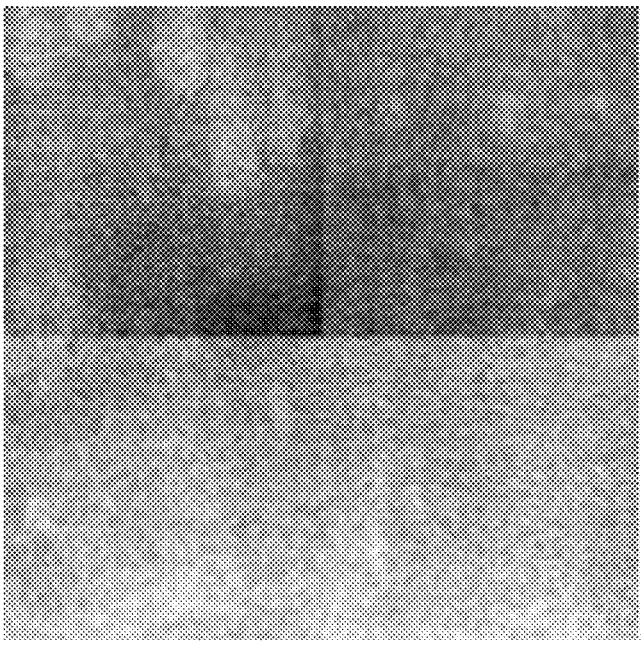
FIGS. 14-16 are diagrams for illustrating an effect of the display device of FIG. 1.
Figure 15:
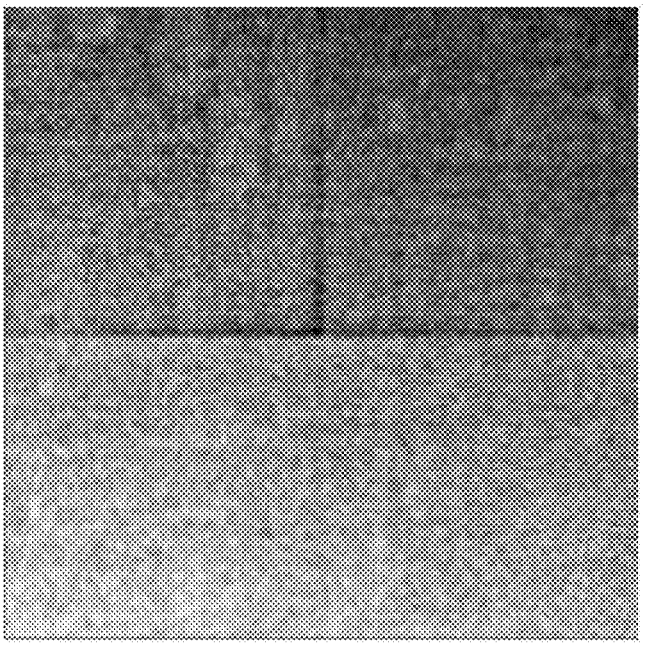
Figure 16:
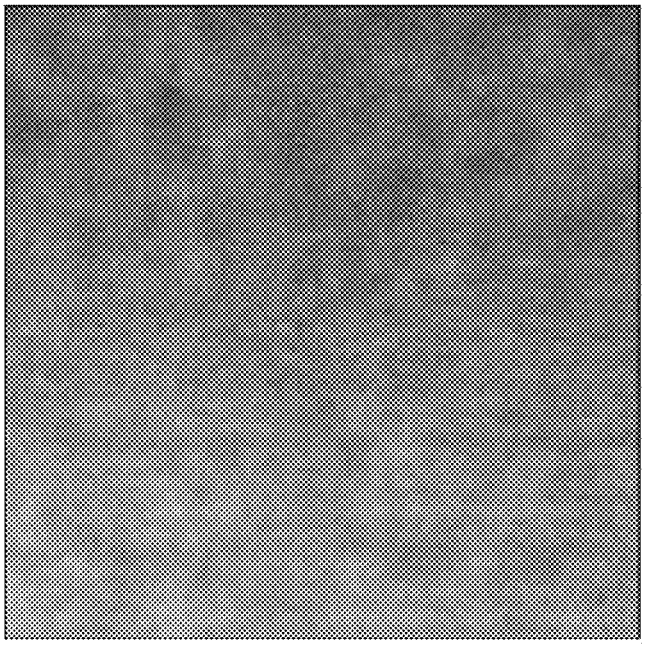

FIGS. 14 to 16 are diagrams for describing an effect of the display device of FIG. 1.

Referring to FIGS. 14 to 16, the display device according to example embodiments may efficiently compensate for a stain having a grid shape by classifying pixels into four regions based on a location where the stain is visually recognized and by performing different sampling compensation operations for the regions.

As illustrated in FIG. 14, when stain compensation is not performed for image data (e.g., when a flash memory device that stores a look-up table is deactivated), the stain having the grid shape may be visually recognized (e.g., by a user) due to deviations of the polarizing layer in a manufacturing process of the display device or other causes.

As illustrated in FIG. 15, when a first sampling compensation operation that uses a sampling matrix having a relatively large size is applied (or performed) for an entire region of the display panel, a compensation error may occur at a location where a stain having a line shape or a grid shape is displayed, and a blurred or smudged stain having the grid shape may be observed.

As illustrated in FIG. 16, the display panel (i.e., the pixels) may be divided into the four regions, compensation data may be generated for the first region where the stain is not observed using a sampling matrix having a relatively large size, and compensation data may be generated for the second through fourth regions where the stain is observed using a sampling matrix having a relatively small size. Thus, it may be confirmed that the stain having the grid shape is effectively removed while the load of the display device is not greatly increased.

Figure 17:
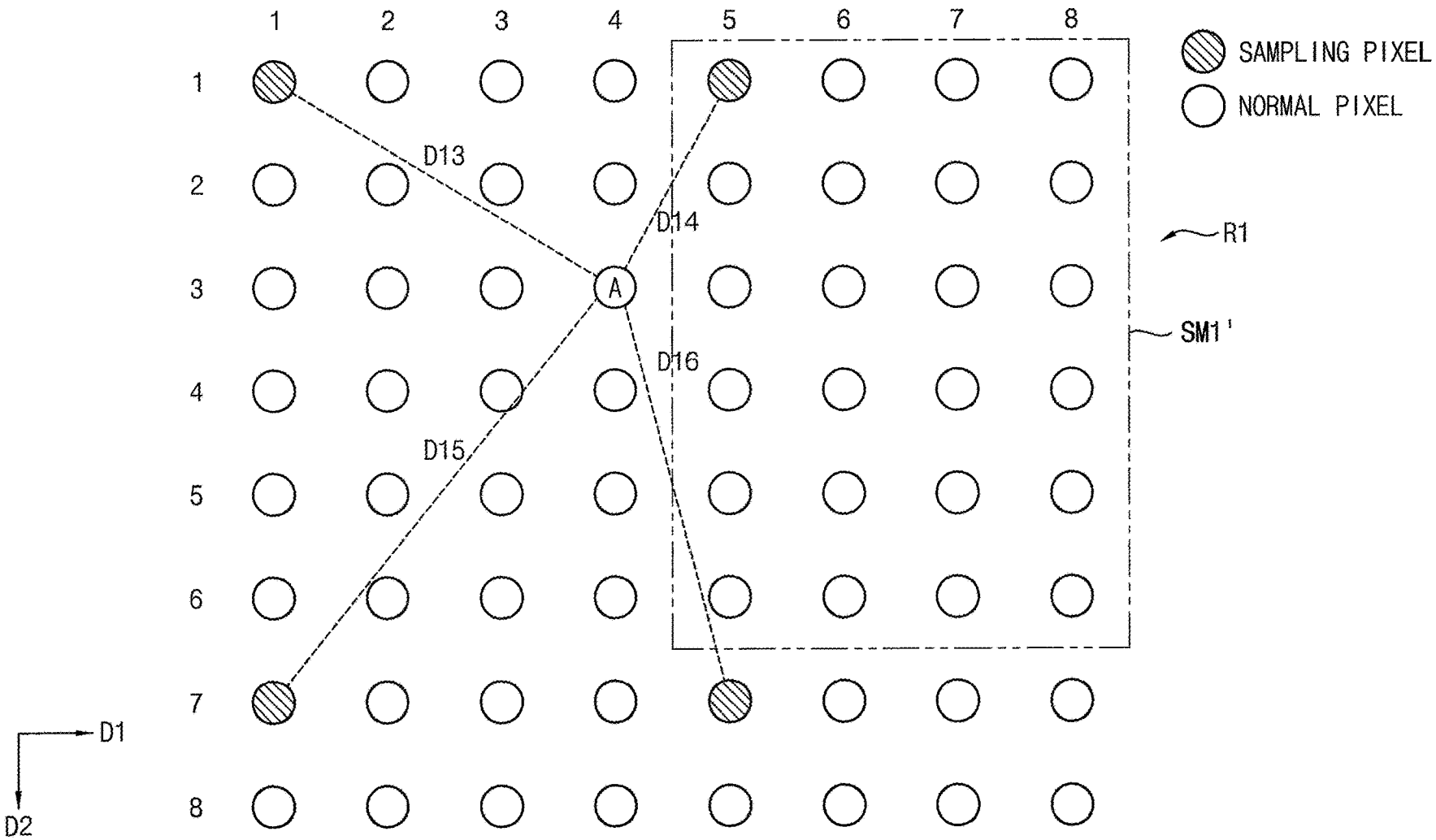
FIG. 17 is a diagram illustrating another example in which a first compensation data for a first region is generated by a first sampling compensation operation, according to some example embodiments of the present inventive concept.

FIG. 17 is a diagram illustrating another example in which a first compensation data for a first region is generated by a first sampling compensation operation, according to some example embodiments of the present inventive concept.

Referring to FIG. 17, the first compensation data for the pixels may be generated by the first sampling compensation operation in the first region R1 corresponding to the location where the stain is not observed.

A first sampling matrix SM1' of the first sampling compensation operation may be a 6×4 sampling matrix, according to some examples. The first sampling compensation operation may divide the first region R1 into blocks each having a size of the 6×4 sampling matrix and may determine one of 24 pixels included in each of the blocks as a sampling pixel for that block. For example, the (1, 1) pixel, the (1, 5) pixel, the (7, 1) pixel, the (7, 5) pixel, etc. may be selected as the sampling pixels.

The compensation values for the sampling pixels may be obtained from the first look-up table. The compensation data for the normal pixel (e.g., the (3, 4) pixel) other than the sampling pixel may be obtained based on the compensation data for the sampling pixels that are adjacent to the normal pixel (e.g., the (1, 1) pixel, the (1, 5) pixel, the (7, 1) pixel, and the (7, 5) pixel) and distances D13, D14, D15, and D16 between the sampling pixels and the normal pixel. Because a method of obtaining the compensation data for the normal pixel is described above, repeat descriptions will not be provided.

Because a size of the 6×4 sampling matrix shown in FIG. 17 is larger than that of the 4×4 sampling matrix shown in FIG. 6, the load of the display device may be reduced when compensation value deviation is relatively not large.

Figure 18:
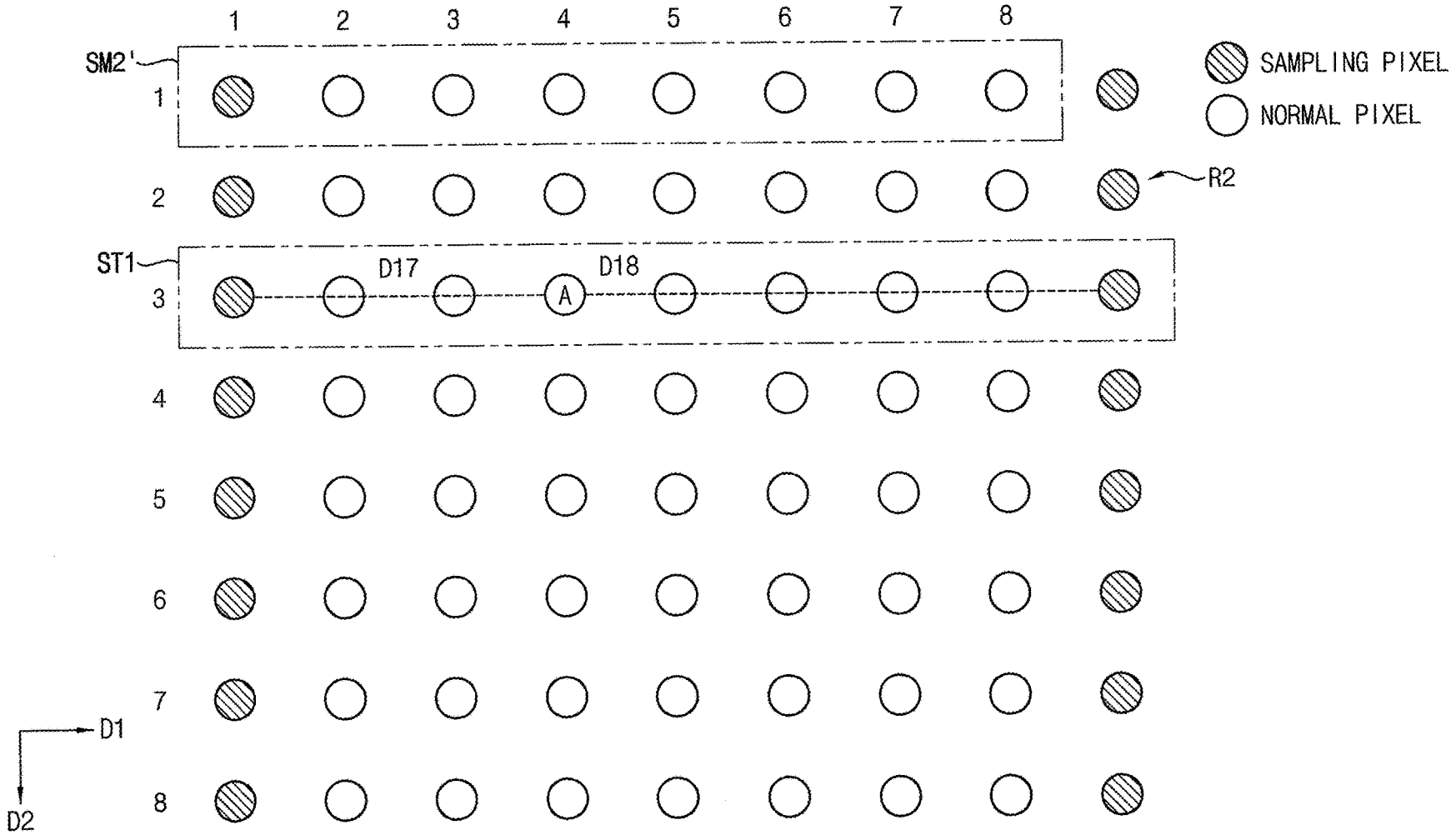
FIGS. 18-19 are diagrams illustrating another example in which a second compensation data for a second region is generated by a second sampling compensation operation, according to some example embodiments of the present inventive concept.
Figure 19:
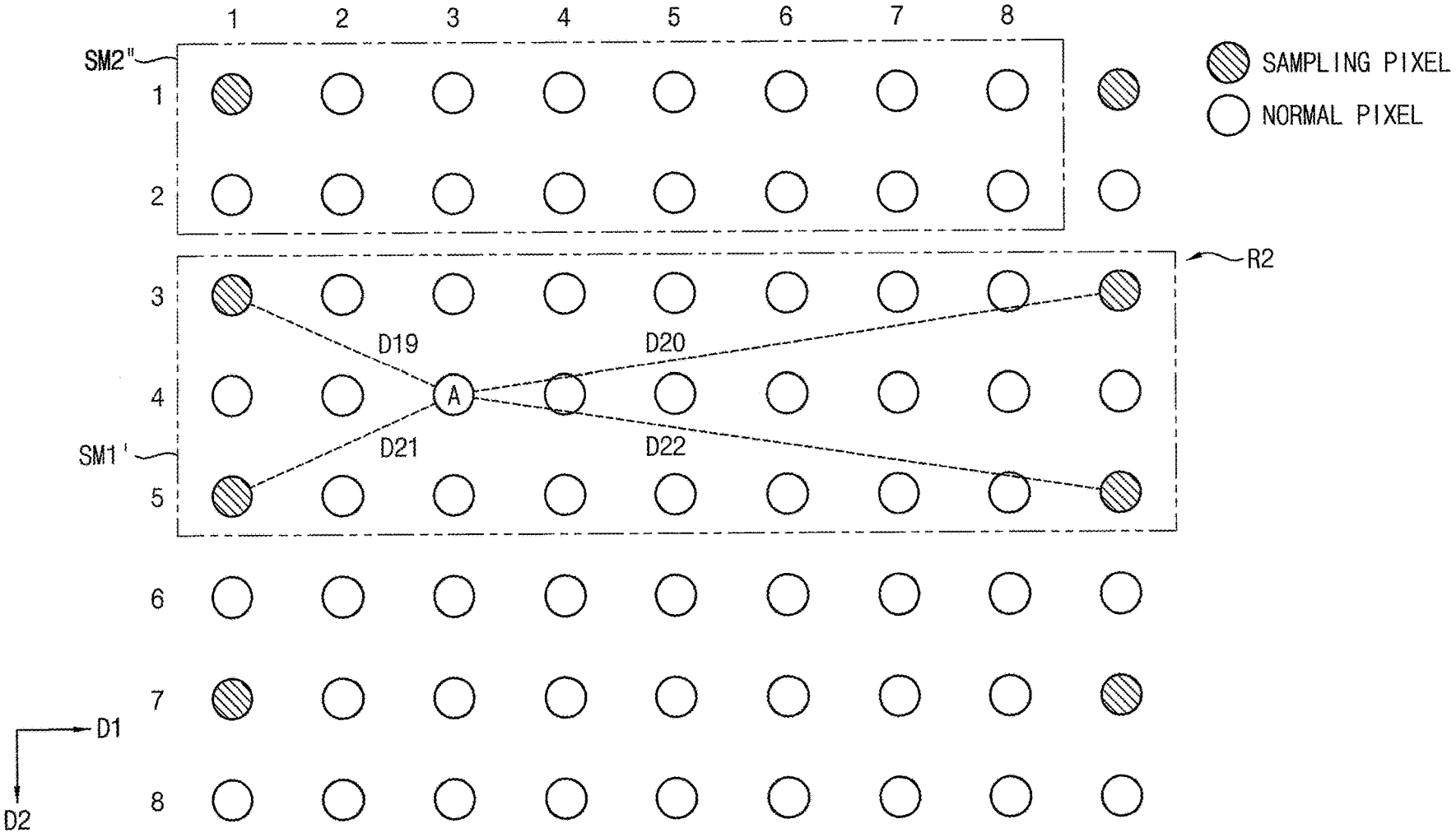

FIGS. 18 and 19 are diagrams illustrating another example in which a second compensation data for a second region is generated by a second sampling compensation operation, according to some example embodiments of the present inventive concept.

Referring to FIGS. 18 and 19, the second compensation data for the pixels may be generated by the second sampling compensation operation in the second region R2 including the first stain ST1 or ST1' displayed along the first line extending in the first direction D1.

As illustrated in FIG. 18, the second sampling matrix SM2' of the second sampling compensation operation may be the 1×8 sampling matrix, according to some examples. The second sampling compensation operation may divide the second region R2 into blocks each having a size of the 1×8 sampling matrix and may determine one of eight pixels included in each of the blocks as the sampling pixel. For example, the pixels located in the first pixel-column, the ninth pixel-column, etc., which are included in the second region R2, may be selected as the sampling pixel.

The compensation values for the sampling pixels may be obtained from the second look-up table. The compensation data for the normal pixel (e.g., the (3, 4) pixel) other than the sampling pixel may be obtained based on the compensation data for the sampling pixels (e.g., the (3, 1) pixel and the (3, 9) pixel) that are adjacent to the normal pixel and the distances D17 and D18 between the sampling pixels and the normal pixel.

Because a size of the 1×8 sampling matrix shown in FIG. 18 is larger than that of the 1×4 sampling matrix shown in FIG. 7A, the load of the display device may be reduced when compensation value deviation is relatively not large when moving in the first direction D1. In an example embodiment, a width of the second sampling matrix may be set to be an integer multiple of a width of the first sampling matrix.

As illustrated in FIG. 19, the second sampling matrix SM2" of the second sampling compensation operation may be the 2×8 sampling matrix. The second sampling compensation operation may divide the second region R2 into blocks each having a size of the 2×8 sampling matrix and may determine one of sixteen pixels included in each of the blocks as the sampling pixel. For example, the pixels located in odd rows of the first pixel-column, odd rows of the ninth pixel-column, etc., which are included in the second region R2, may be selected as the sampling pixel.

The compensation values for the sampling pixels may be obtained from the second look-up table. The compensation data for the normal pixel (e.g., the (4, 3) pixel) other than the sampling pixel may be obtained based on the compensation data for the sampling pixels (e.g., the (3, 1) pixel, the (3, 9) pixel, the (5, 1) pixel, and the (5, 9) pixel) that are adjacent to the normal pixel and the distances D19, D20, D21, and D22 between the sampling pixels and the normal pixel.

When a width of the first stain ST1' extending in the first direction D1 is relatively wide, the load of the display device may be reduced by obtaining the compensation data using the 2×8 sampling matrix SM2" shown in FIG. 19 as compared to obtaining the compensation data using the 1×8 sampling matrix SM2' shown in FIG. 18.

Figure 20:
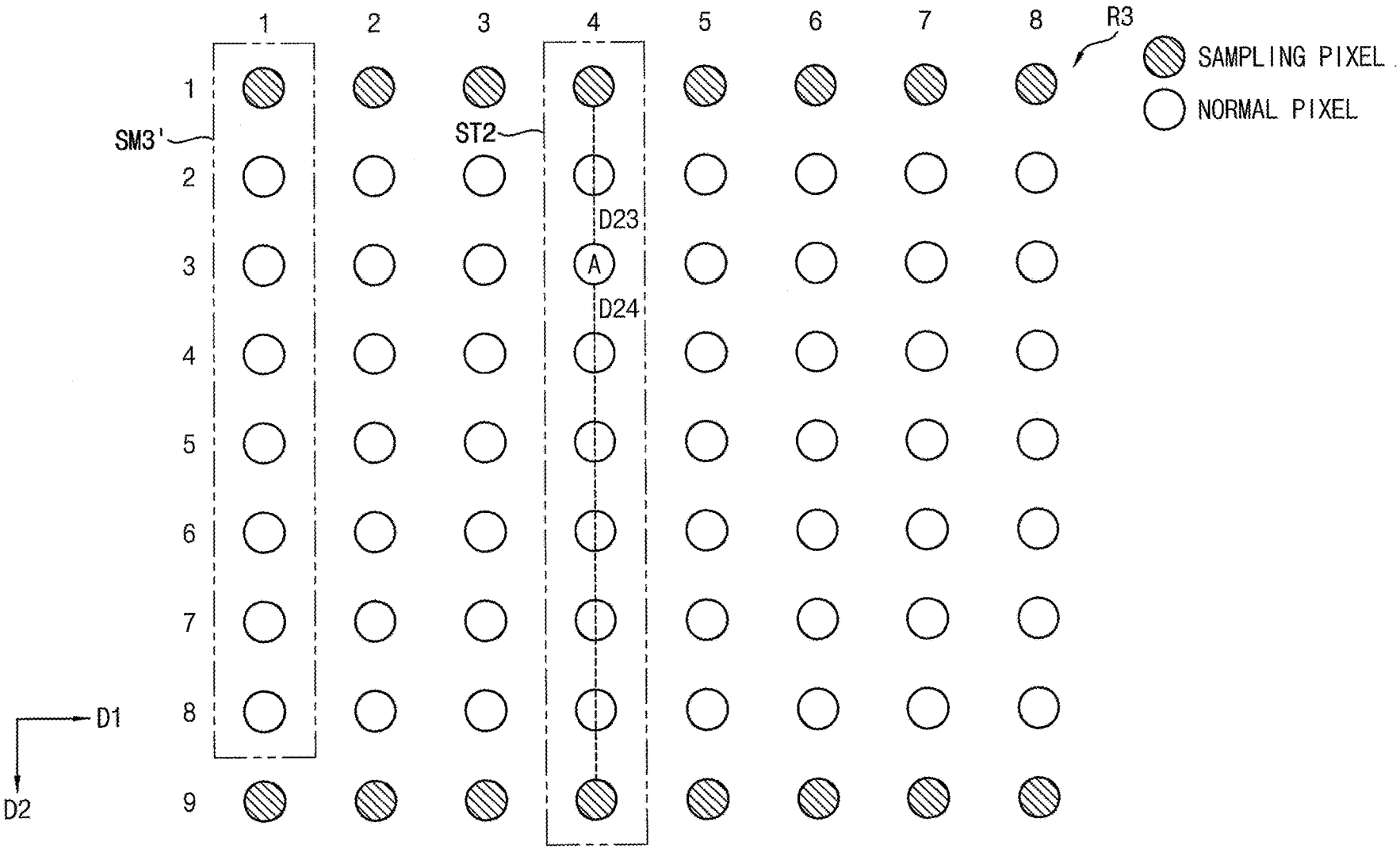
FIGS. 20-21 are diagrams illustrating another example in which a third compensation data for a third region is generated by a third sampling compensation operation, according to some example embodiments of the present inventive concept.
Figure 21:
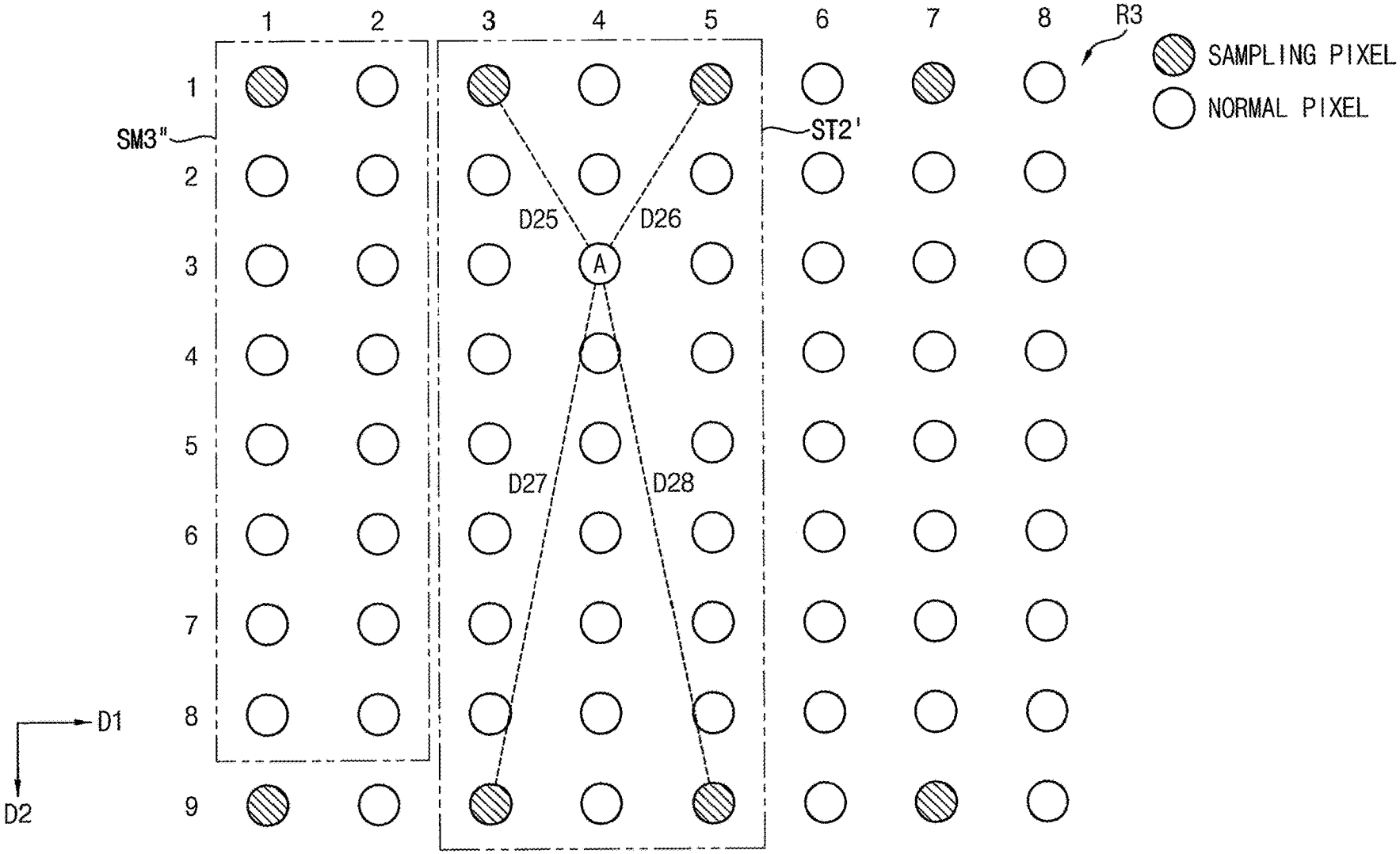

FIGS. 20 and 21 are diagrams illustrating another example in which a third compensation data for a third region is generated by a third sampling compensation operation, according to some example embodiments of the present inventive concept.

Referring to FIGS. 20 and 21, the third compensation data for the pixels may be generated by the third sampling compensation operation in the third region R3 including the second stain ST2 or ST2' displayed along the second line extending in the second direction D2.

As illustrated in FIG. 20, the third sampling matrix SM3' of the third sampling compensation operation may be an 8×1 sampling matrix, according to some examples. The third sampling compensation operation may divide the third region R3 into blocks each having a size of the 8×1 sampling matrix and may determine one of eight pixels included in each of the blocks as the sampling pixel. For example, the pixels located in the first pixel-row, the ninth pixel-row, etc., which are included in the third region R3, may be selected as the sampling pixel.

The compensation values for the sampling pixels may be obtained from the third look-up table. The compensation data for the normal pixel (e.g., the (3, 4) pixel) other than the sampling pixel may be obtained based on the compensation data for the sampling pixels (e.g., the (1, 4) pixel and the (9, 4) pixel) that are adjacent to the normal pixel and the distances D23 and D24 between the sampling pixels and the normal pixel.

Because a size of the 8×1 sampling matrix shown in FIG. 20 is larger than that of the 4×1 sampling matrix shown in FIG. 8A, the load of the display device may be reduced when compensation value deviation is relatively not large when moving in the second direction D2. In an example embodiment, a height of the second sampling matrix may be set to be an integer multiple of a height of the first sampling matrix.

As illustrated in FIG. 21, the third sampling matrix SM3" of the third sampling compensation operation may be an 8×2 sampling matrix, according to some examples. The third sampling compensation operation may divide the third region R3 into blocks each having a size of the 8×2 sampling matrix and may determine one of sixteen pixels included in each of the blocks as the sampling pixel. For example, the pixels located in odd columns of the first pixel-row, odd columns of the ninth pixel-row, etc., which are included in the third region R3, may be selected as the sampling pixel.

The compensation values for the sampling pixels may be obtained from the third look-up table. The compensation data for the normal pixel (e.g., the (4, 3) pixel) other than the sampling pixel may be obtained based on the compensation data for the sampling pixels (e.g., the (1, 3) pixel, the (1, 5) pixel, the (9, 3) pixel, and the (9, 5) pixel) that are adjacent to the normal pixel and the distances D25, D26, D27, and D28 between the sampling pixels and the normal pixel.

When a width of the second stain ST2' displayed along the second line extending in the second direction D2 is relatively wide, the load of the display device may be reduced by obtaining the compensation data using the 8×2 sampling matrix shown in FIG. 21 as compared to obtaining the compensation data using the 8×1 sampling matrix shown in FIG. 20.

Figure 22:
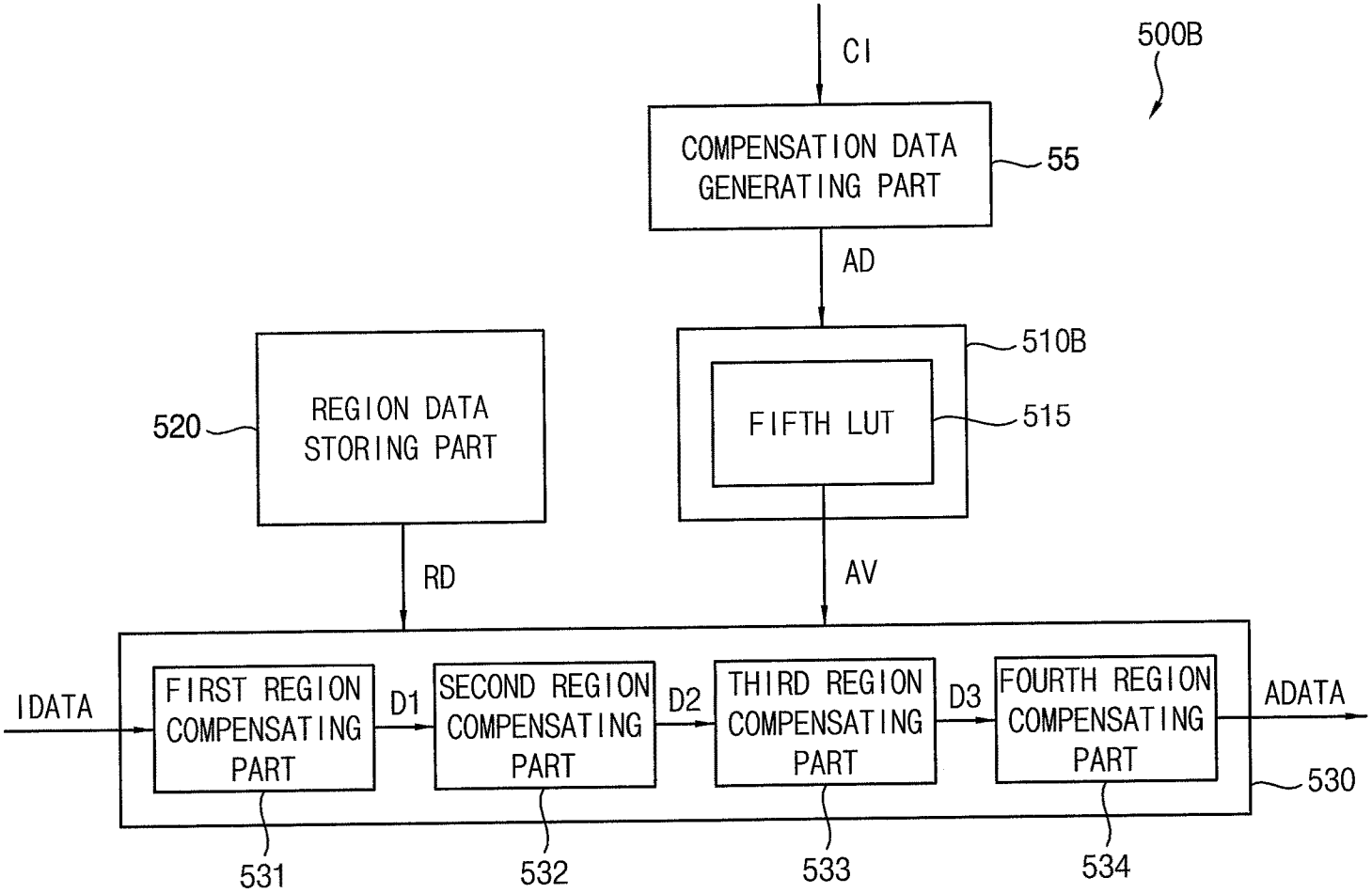
FIG. 22 is a block diagram illustrating another example of an image compensator included in the display device of FIG. 1.

FIG. 22 is a block diagram illustrating another example of an image compensator included in the display device of FIG. 1.

Referring to FIG. 22, the image compensator 500B may compensate image data by performing different sampling compensation operations for first through fourth regions. In an example embodiment, the image compensator 500B may include a compensation data storing part 510B, a region data storing part (e.g., a region data storage) 520, and a data compensating part 530.

The compensation data storing part 510B may include the look-up table that stores the compensation data for the sampling pixels to perform the sampling compensation operations. In an example embodiment, the compensation data storing part 510B may include a fifth look-up table 515. Because the structure of the look-up table is described above, a description thereof will not be repeated.

The data compensating part 530 may perform respective sampling compensation operations based on the region data RD and the compensation data AV for the sampling pixel stored in the fifth look-up table. In an example embodiment, the data compensating part 530 may include first through fourth region compensating parts 531 through 534.

The first region compensating part 531 may obtain the first compensation data by performing the first sampling compensation operation based on the region data RD and the fifth look-up table 515 and may compensate the image data of the pixels corresponding to the first region based on the first compensation data. For example, the first region compensating part 531 may generate the compensation data for the normal pixel of the first region by determining the first region based on the region data RD and by obtaining the compensation data for the sampling pixel included in the first region from the fifth look-up table 515. In an example embodiment, the first region compensating part 531 may generate the first data D1 by compensating the input image data IDATA for the first region based on the fifth look-up table 515.

The second region compensating part 532 may obtain the second compensation data by performing the second sampling compensation operation based on the region data RD and the fifth look-up table 515 and may compensate the image data of the pixels corresponding to the second region based on the second compensation data. In an example embodiment, the second region compensating part 532 may generate the second data D2 by compensating the first data D1 for the second region based on the fifth look-up table 515.

The third region compensating part 533 may obtain the third compensation data by performing the third sampling compensation operation based on the region data RD and the fifth look-up table 515 and may compensate the image data of the pixels corresponding to the third region based on the third compensation data. In an example embodiment, the third region compensating part 533 may generate the third data D3 by compensating the second data D2 for the third region based on the fifth look-up table 515.

The fourth region compensating part 534 may obtain the fourth compensation data by performing the fourth sampling compensation operation based on the region data RD stored in the region data storing part 520 and the fifth look-up table 515 and may compensate the image data of the pixels corresponding to the fourth region based on the fourth compensation data. In an example embodiment, the fourth region compensating part 534 may generate the compensated image data ADATA by compensating the third data D3 for the fourth region based on the fifth look-up table 515.

The fifth look-up table 515 of the image compensator 500B may be generated by the compensation data generating part 50 that is located inside or outside the display device. For example, the compensation data generating part 50 may generate data of the fifth look-up table 515 based on the photographed image of the display panel 100. Because the compensation data generating part 50 is the same or substantially the same as the compensation data generating part described with reference to FIG. 4, a description thereof will not be repeated.

As described above, the sampling compensation operations for the regions may be performed based on the fifth look-up table 515 by using the region data RD stored in the region data storing part 520. Thus, the image compensator 500B of FIG. 22 may be implemented to include a memory device having relatively small capacity as compared to the image compensator 500A of FIG. 4.

Figure 23:
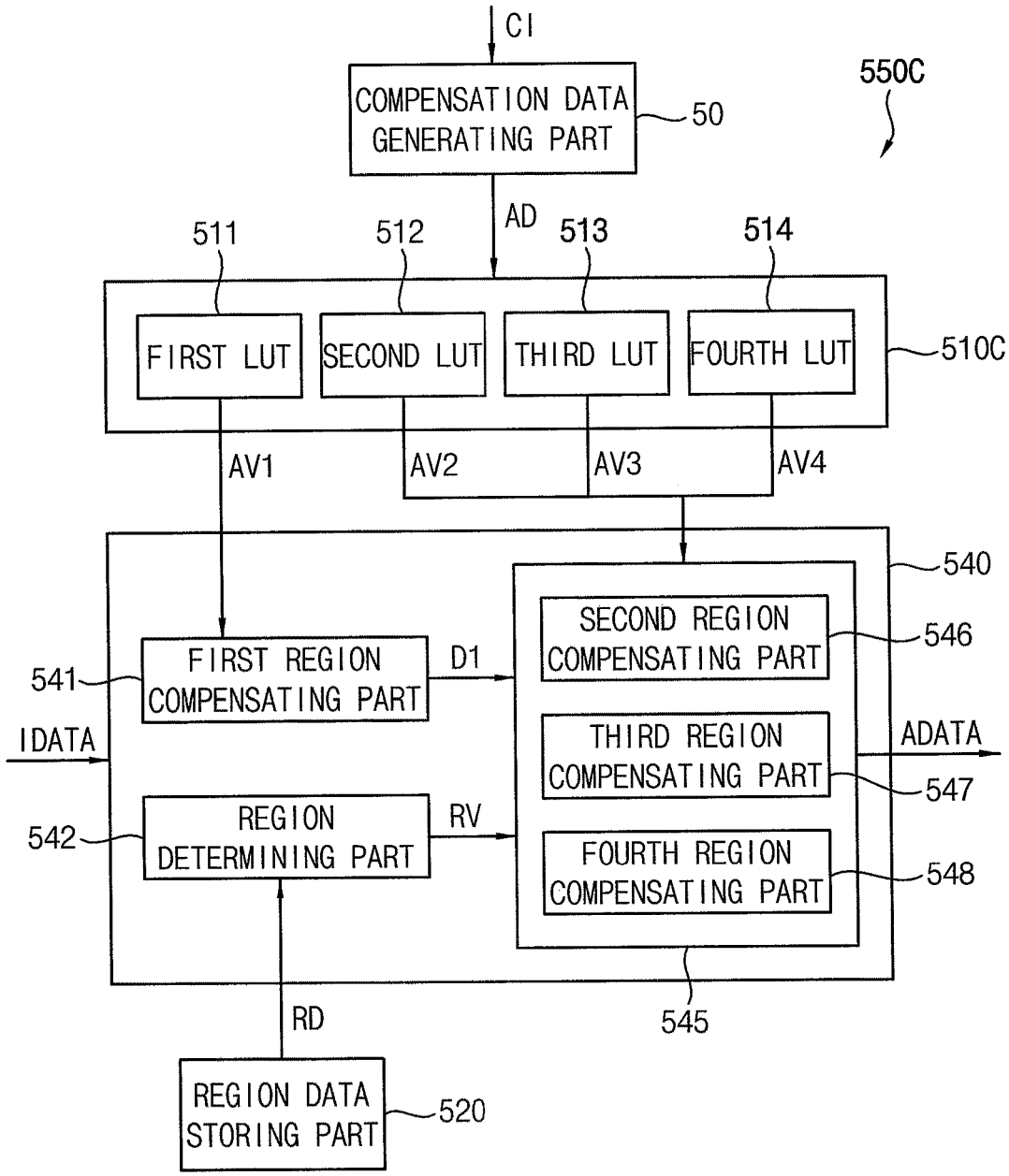
FIG. 23 is a block diagram illustrating still another example of an image compensator included in the display device of FIG. 1.

FIG. 23 is a block diagram illustrating still another example of an image compensator included in the display device of FIG. 1.

Referring to FIG. 23, the image compensator 500C may compensate image data by performing different sampling compensation operations for first through fourth regions. In an example embodiment, the image compensator 500C may include a compensation data storing part (e.g., a compensation data storage) 510C, a region data storing part (e.g., a region data storage) 520, and a data compensating part (e.g., a data compensator) 540.

The compensation data storing part 510C may include the look-up table 511 through 514 that stores the compensation data for the sampling pixels to perform the sampling compensation operations. Because the structure of the look-up table is described above, repeat descriptions will not be provided.

The data compensating part 540 may perform respective sampling compensation operations based on the region data RD and the compensation data AV1 through AV4 for the sampling pixel stored in the first through fourth look-up tables 511 through 514. In an example embodiment, the data compensating part 540 may include a first region compensating part (e.g., a first region compensator) 541, a region determining part (e.g., a region determiner) 542, and a partial region compensating part (e.g., a partial region compensator) 545.

The first region compensating part 541 may obtain the first compensation data by performing the first sampling compensation operation based on the first look-up table 511 and may compensate the image data of the pixels corresponding to the first region based on the first compensation data. For example, the first region compensating part 541 may generate the compensation data for the normal pixel included in an entire region of the display panel by obtaining the compensation data for the sampling pixel included in the entire region of the display panel from the first look-up table 511. The first region compensating part 541 may generate the first data D1 by compensating the input image data IDATA for the entire region of the display panel based on the first look-up table 511.

The region determining part 542 may output the region data value RV for dividing the input image data DATA for the first through fourth regions based on the region data RD stored in the region data storing part 520.

The partial region compensating part 545 may generate the compensated image data ADATA by performing the second through fourth sampling compensation operations on the first data D1 generated by the first region compensating part 541 for the second through fourth regions, respectively, where the second through fourth regions are divided based on the region data value RV. In an example embodiment, the partial region compensating part 545 may include the second through fourth region compensating parts (e.g., second through fourth region compensators) 546, 547, and 548. The second region compensating part 546 may obtain the second compensation data by performing the second sampling compensation operation based on the second look-up table 514 and may compensate the image data for the pixels corresponding to the second region based on the second compensation data. The third region compensating part 547 may obtain the third compensation data by performing the third sampling compensation operation based on the third look-up table and may compensate the image data for the pixels corresponding to the third region based on the third compensation data. The fourth region compensating part 548 may obtain the fourth compensation data by performing the fourth sampling compensation operation based on the fourth look-up table and may compensate the image data for the pixels corresponding to the fourth region based on the fourth compensation data.

Although it is illustrated in FIG. 23 that the compensation data storing part 510C is separated from the region data storing part 520, the present inventive concept is not limited thereto. For example, the region data RD may be stored in the compensation data storing part 510C. For example, the region data RD may be stored in the first through fourth look-up tables 511 through 514 of the compensation data storing part 510C.

Figure 24:
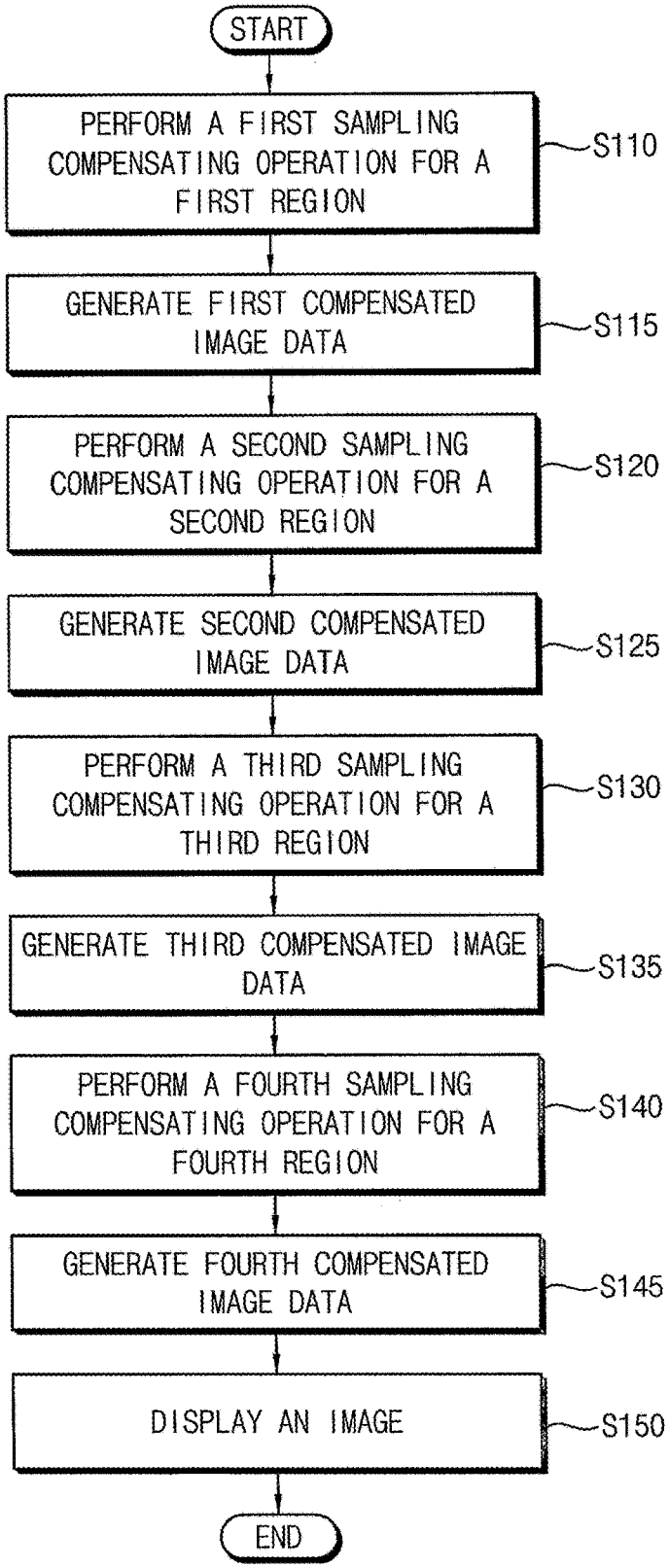
FIG. 24 is a flow diagram illustrating a method of driving a display device according to some example embodiments of the present inventive concept.

FIG. 24 is a flow diagram illustrating a method of driving a display device according to some example embodiments of the present inventive concept.

Referring to FIG. 24, the method of FIG. 24 may classify pixels into first through fourth regions based on a location where a stain is formed (or observed) and may compensate for the stain by performing different sampling compensation operations for the first through fourth regions. Because a method of classifying the pixels into the first through fourth regions is described above, repeat descriptions will not be provided.

For example, the first sampling compensation operation is performed (S110) based on a first look-up table to obtain compensation data for the pixels included in the first region. In addition, first compensated image data may be generated (S115) by compensating input image data based on the compensation data for the pixels included in the first region. In an example embodiment, a first sampling matrix of the first sampling compensation operation may be an R1×C1 sampling matrix, where R1 and C1 are integers greater than 1. That is, the compensation data for the pixels included in the first region where the stain is not observed may be generated by using the sampling matrix having a relatively large size.

The second sampling compensation operation is performed (S120) based on a second look-up table to obtain compensation data for the pixels included in the second region. In addition, second compensated image data may be generated (S125) by compensating the input image data (or the first compensated image data) based on the compensation data for the pixels included in the second region. In an example embodiment, a second sampling matrix of the second sampling compensation operation may be an R2×C2 sampling matrix, where R2 is an integer greater than or equal to R1, and C2 is an integer greater than or equal to 1 and smaller than C1. That is, the compensation data for the pixels included in the second region where the stain extending in a first direction D1 is observed may be generated by using the sampling matrix having a relatively small size.

The third sampling compensation operation is performed (S130) based on a third look-up table to obtain compensation data for the pixels included in the third region. In addition, third compensated image data may be generated (S135) by compensating the input image data (or the second compensated image data) based on the compensation data for the pixels included in the third region. In an example embodiment, a third sampling matrix of the third sampling compensation operation may be an R3×C3 sampling matrix, where R3 is an integer greater than or equal to 1 and smaller than R1, and C3 is an integer greater than or equal to C1. That is, the compensation data for the pixels included in the third region where the stain extending in a second direction D2 is observed may be generated by using the sampling matrix having a relatively small size.

The fourth sampling compensation operation is performed (S140) based on a fourth look-up table to obtain compensation data for the pixels included in the fourth region. In addition, fourth compensated image data may be generated (S145) by compensating the input image data (or the third compensated image data) based on the compensation data for the pixels included in the fourth region. In an example embodiment, a fourth sampling matrix of the fourth sampling compensation operation may be an R4×C4 sampling matrix, where R4 is an integer greater than or equal to 1 and smaller than R1, and C4 is an integer greater than or equal to 1 and smaller than C1. That is, the compensation data for the pixels included in the fourth region where the stain extending in the first direction D1 intersects (or overlaps) with the stain extending in the second direction D2 may be generated by using the sampling matrix having the smallest size.

An image may be displayed based on the first through fourth image data (S150).

Therefore, the method of FIG. 24 may efficiently remove the stain of the display device by sequentially performing the sampling compensation operations in the order of larger sizes of the sampling matrices for the regions that are divided based on the location of the stain.

Figure 25:
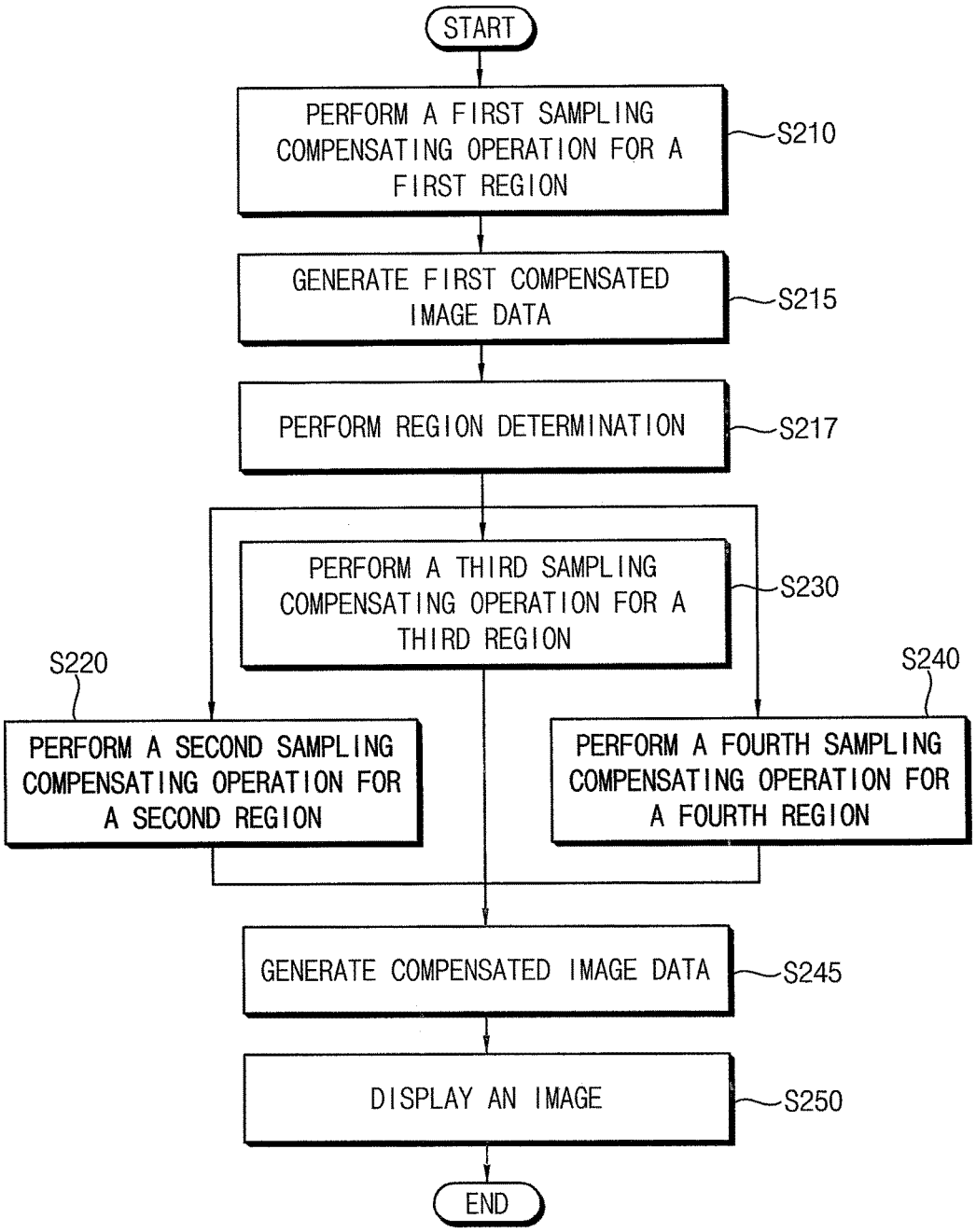
FIG. 25 is a flow diagram illustrating a method of driving a display device according to some example embodiments of the present inventive concept.

FIG. 25 is a flow diagram illustrating a method of driving a display device according to some example embodiments of the present inventive concept.

Referring to FIG. 25, the method of FIG. 25 may classify pixels into first through fourth regions based on a location where a stain is formed (or observed) and may compensate for the stain by performing different sampling compensation operations for the first through fourth regions. Except for the second through fourth sampling compensation operations that are performed in parallel, the method of FIG. 25 is substantially the same as the method of FIG. 24. Thus, identical reference numerals will be used for identical or similar components, and repeat descriptions will not be provided.

For example, the first sampling compensation operation is performed (S210) based on a first look-up table to obtain compensation data for the pixels included in an entire region of the display panel. In addition, first compensated image data may be generated (S215) by compensating input image data based on the compensation data for the pixels included in the first region.

A region to which the first compensated image data belongs may be determined (S217). In addition, the second through fourth sampling compensation operations may be performed according to the region to which the first compensated image data belongs.

When the first compensated image data corresponds to the second region, the second sampling compensation operation may be performed based on a second look-up table (S220) to update the compensation data for the pixels included in the second region. The first compensated image data may be updated based on the compensation data for the pixels included in the second region.

When the first compensated image data corresponds to the third region, the third sampling compensation operation may be performed based on a third look-up table (S230) to update the compensation data for the pixels included in the third region. The first compensated image data may be updated based on the compensation data for the pixels included in the third region.

When the first compensated image data corresponds to the fourth region, the fourth sampling compensation operation may be performed based on a fourth look-up table (S240) to update the compensation data for the pixels included in the fourth region. The first compensated image data may be updated based on the compensation data for the pixels included in the fourth region.

Thus, the compensated image data may be generated from the first compensated image data by the second through fourth sampling compensation operations (S245). As a result, an image may be displayed based on the compensated image data (S250).

Although a display device and a method of driving a display device according to example embodiments are described above with reference to figures, those skilled in the art will readily appreciate that many modifications are possible in the example embodiments without materially departing from the novel teachings and advantages of the present inventive concept. For example, although it is described above that the display device is a liquid crystal display device or an organic light emitting display device, the type of the display device is not limited thereto.

The present inventive concept may be applied to an electronic device that includes a display device. For example, the present inventive concept may be applied to a computer monitor, a laptop, a cellular phone, a smart phone, a smart pad, a smart watch, a tablet PC, a portable multimedia player (PMP), a personal digital assistant (PDA), an MP3 player, a digital camera, a video camcorder, and/or the like.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "under" other elements or features would then be oriented "above" the other elements or features. Thus, the example term "under" can encompass both an orientation of above and below. The device may be otherwise oriented (e.g., rotated 90 degrees or at other orientations) and the spatially relative descriptors used herein should be interpreted accordingly. In addition, it will also be understood that when a layer or block is referred to as being "between" two layers or blocks, it can be the only layer or block between the two layers or blocks, or one or more intervening layers or blocks may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ.

Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein, such as the image compensator and the timing controller, may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that suitable modifications to the disclosed example embodiments, as well as other example embodiments, are intended to be included within the scope of the invention as defined by the appended claims and equivalents.

What is claimed is:

1. A display device comprising:

a display panel comprising a plurality of pixels corresponding to a plurality of regions;

an image compensator configured to obtain compensation data for the pixels by performing respective sampling compensation operations for the regions, and to generate compensated image data by compensating input image data based on the compensation data, the compensation data being generated by performing first and second sampling compensation operations of the sampling compensation operations for first and second regions of the plurality of regions based on respective first and second sampling matrices having different sizes; and a display panel driver configured to drive the display panel to display an image corresponding to the compensated image data on the display panel.

2. The display device of claim 1, wherein the regions comprise a first region, a second region, a third region, and a fourth region, wherein the fourth region corresponds to at least a portion of a region at which a first stain corresponding in location to a first line extending in a first direction intersects with a second stain corresponding in location to a second line extending a second direction that is different from the first direction, wherein the third region corresponds to at least a portion of a region corresponding to the second line, wherein the second region corresponds to at least a portion of a region corresponding to the first line, and wherein the first region corresponds to at least a portion of a region other than the second region, the third region, and the fourth region.

3. The display device of claim 2, wherein the sampling compensation operations comprise a first sampling compensation operation, a second sampling compensation operation, a third sampling compensation operation, and a fourth sampling compensation operation, wherein the first sampling compensation operation generates the compensation data for the first region based on a first sampling matrix having a size of R1 pixel-rows and C1 pixel-columns, where R1 and C1 are integers greater than 1, wherein the second sampling compensation operation generates the compensation data for the second region based on a second sampling matrix having a size of R2 pixel-rows and C2 pixel-columns, where R2 is an integer greater than or equal to R1, and C2 is an integer greater than or equal to 1 and smaller than C1, wherein the third sampling compensation operation generates the compensation data for the third region based on a third sampling matrix having a size of R3 pixel-rows and C3 pixel-columns, where R3 is an integer greater than or equal to 1 and smaller than R1, and C3 is an integer greater than or equal to C1, and wherein the fourth sampling compensation operation generates the compensation data for the fourth region based on a fourth sampling matrix having a size of R4 pixel-rows and C4 pixel-columns, where R4 is an integer greater than or equal to 1 and smaller than R1, and C4 is an integer greater than or equal to 1 and smaller than C1.

4. The display device of claim 3, wherein the image compensator is configured to perform the first sampling compensation operation, the second sampling compensation operation, the third sampling compensation operation, and the fourth sampling compensation operation sequentially.

5. The display device of claim 3, wherein a quantity of the R2 pixel-rows is an integer multiple of a quantity of the R1 pixel-rows, and wherein a quantity of the C3 pixel-columns is an integer multiple of a quantity of the C1 pixel-columns.

6. The display device of claim 3, wherein the fourth sampling matrix has a size of one pixel-row and one pixel-column.

7. The display device of claim 1, wherein the display panel driver comprises:

a compensation data storage configured to store different look-up tables for performing the sampling compensation operations; and a data compensator configured to perform the sampling compensation operations based on the look-up tables.

8. The display device of claim 7, wherein the data compensator is configured to perform the sampling compensation operations in an order of larger sizes of the sampling matrices.

9. The display device of claim 7, wherein the display panel driver further comprises:

a compensation data generator configured to generate the look-up tables based on a photographed image of the display panel.

10. The display device of claim 9, wherein the compensation data generator comprises:

a luminance profile obtainer configured to obtain a luminance profile of at least a portion of the pixels from the photographed image;

a luminance target value obtainer configured to obtain a luminance target value corresponding to a reference gray-scale value;

a luminance compensation value generator configured to generate a luminance compensation value based on the luminance profile and the luminance target value; and a compensation data generator configured to generate the compensation data based on the luminance compensation value.

11. The display device of claim 1, wherein the display panel comprises a first substrate on which a polarizing layer is formed, and wherein the regions are divided based on a boundary of the polarizing layer.

12. The display device of claim 11, wherein the boundary of the polarizing layer has a line shape.

13. The display device of claim 11, wherein the display panel further comprises a second substrate that is opposite to the first substrate, and wherein the polarizing layer is between the first substrate and the second substrate.

14. The display device of claim 13, wherein the polarizing layer is a wire grid polarizing layer.

15. A method of driving a display device that comprises a plurality of pixels corresponding to a plurality of regions, the method comprising:

generating compensated image data by compensating input image data based on compensation data for the pixels; and displaying an image corresponding to the compensated image data, wherein the compensation data is obtained by performing respective sampling compensation operations for the regions, and wherein the compensation data is generated by performing first and second sampling compensation operations of the sampling compensation operations for first and second regions of the plurality of regions based on respective first and second sampling matrices having different sizes.

16. The method of claim 15, wherein the regions comprise a first region, a second region, a third region, and a fourth region, wherein the fourth region corresponds to at least a portion of a region at which a first stain corresponding in location to a first line extending in a first direction intersects with a second stain corresponding in location to a second line extending a second direction that is different from the first direction, wherein the third region corresponds to at least a portion of a region corresponding to the second line, wherein the second region corresponds to at least a portion of a region corresponding to the first line, and wherein the first region corresponds to at least a portion of a region other than the second region, the third region, and the fourth region.

17. The method of claim 16, wherein the sampling compensation operations comprise a first sampling compensation operation, a second sampling compensation operation, a third sampling compensation operation, and a fourth sampling compensation operation, wherein the first sampling compensation operation generates the compensation data for the first region based on a first sampling matrix having a size of R1 pixel-rows and C1 pixel-columns, where R1 and C1 are integers greater than 1, wherein the second sampling compensation operation generates the compensation data for the second region based on a second sampling matrix having a size of R2 pixel-rows and C2 pixel-columns, where R2 is an integer greater than or equal to R1, and C2 is an integer greater than or equal to 1 and smaller than C1, wherein the third sampling compensation operation generates the compensation data for the third region based on a third sampling matrix having a size of R3 pixel-rows and C3 pixel-columns, where R3 is an integer greater than or equal to 1 and smaller than R1, and C3 is an integer greater than or equal to C1, and wherein the fourth sampling compensation operation generates the compensation data for the fourth region based on a fourth sampling matrix having a size of R4 pixel-rows and C4 pixel-columns, where R4 is an integer greater than or equal to 1 and smaller than R1, and C4 is an integer greater than or equal to 1 and smaller than C1.

18. The method of claim 17, wherein the first sampling compensation operation, the second sampling compensation operation, the third sampling compensation operation, and the fourth sampling compensation operation are sequentially performed.

19. The method of claim 15, wherein the sampling compensation operations are performed based on respective look-up tables.

20. The method of claim 15, wherein the display device comprises a substrate on which a polarizing layer is formed, and wherein the regions are divided based on a boundary of the polarizing layer.

21. A method of driving a display device that comprises a plurality of pixels corresponding to first and second regions, the method comprising:

performing a first sampling compensation operation that generates first compensation data for the first region based on a first sampling matrix;

generating first compensated image data by compensating input image data for the first region based on the first compensation data;

performing a second sampling compensation operation that generates second compensation data for the second region based on a second sampling matrix;

generating second compensated image data by compensating input image data for the second region based on the second compensation data; and displaying an image corresponding to the first and second compensated image data, wherein a first size of the first sampling matrix is larger than a second size of the second sampling matrix.

22. The method of claim 21, wherein the first sampling compensation operation is performed based on a first look-up table, and wherein the second sampling compensation operation is performed based on a second look-up table that is different from the first look-up table.

* * * * *